US007568741B2

(12) United States Patent
Odahara

(10) Patent No.: US 7,568,741 B2
(45) Date of Patent: Aug. 4, 2009

(54) DOOR LOCK SYSTEM

(75) Inventor: Jun Odahara, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 67 days.

(21) Appl. No.: 11/889,535

(22) Filed: Aug. 14, 2007

(65) Prior Publication Data

US 2008/0078215 A1 Apr. 3, 2008

(30) Foreign Application Priority Data

Oct. 2, 2006 (JP) ..... 2006-271107

(51) Int. Cl.
*E05C 3/06* (2006.01)

(52) U.S. Cl. ..... 292/216; 292/DIG. 23; 292/201

(58) Field of Classification Search ..... 292/216, 292/201, DIG. 23, DIG. 61
See application file for complete search history.

(56) References Cited

U.S. PATENT DOCUMENTS 5,054,827 A * 10/1991 Konchan et al. ..... 292/216
5,277,461 A * 1/1994 Dzurko et al. ..... 292/216
5,918,917 A * 7/1999 Elton et al. ..... 292/201
6,010,165 A * 1/2000 Santarelli et al. ..... 292/216
6,045,168 A * 4/2000 Johnson et al. ..... 292/216
6,050,620 A * 4/2000 Rogers et al. ..... 292/216
2005/1218662 10/2005 Umino

FOREIGN PATENT DOCUMENTS

| | | | |
|---|---|---|---|
| EP | 1 136 641 | A1 | 9/2001 |
| GB | 2 409 496 | A | 6/2005 |
| JP | 3574990 | B2 | 7/2004 |
| JP | 2005-282221 | A | 10/2005 |
| WO | WO 2006/099730 | A1 | 9/2006 |

* cited by examiner

*Primary Examiner*—Patricia Engle
*Assistant Examiner*—Mark Williams
(74) *Attorney, Agent, or Firm*—Foley & Lardner LLP

(57) ABSTRACT

A door lock system includes a first link lever, a second link lever, and a spring. The first link lever moves to a transmitting position in response to an unlocking operation. The second link lever includes a ratchet driver that is formed integrally with a bushing. The ratchet driver is rotatable between a first rotational position and a second rotational position on the first link lever. In response to a door-opening operation, when the ratchet driver is in the first rotational position and the first link lever is in the transmitting position, the second link lever allows a ratchet lever to disengage a ratchet from a latch. The spring maintains the second link lever in the first rotational position when the first link lever moves to the transmitting position.

2 Claims, 17 Drawing Sheets

DOOR LOCK SYSTEM

BACKGROUND OF THE INVENTION

1. Field of the Invention

The present invention relates to a door lock system for a vehicle.

2. Description of the Related Art

When a door-opening operation is performed on a door lock system in a locked position using an outside handle of a vehicle while an unlocking operation is simultaneously performed using an inside lock knob of the vehicle, the door-opening and the unlocking operations interfere each other. This may bring a state (hereinafter, "panic state") in which neither the door-opening operation nor the unlocking operation is attained. For example, Japanese Patent Application Laid-open No. 2005-282221 discloses a conventional door lock system provided with anti-panic mechanism for avoiding such a panic state.

The conventional door lock system includes a ratchet lever, an opening lever, a sector gear, a link lever, an anti-panic lever, and a spring. The ratchet lever is interconnected with a ratchet and disengages the ratchet from a latch. The opening lever is rotatable in response to a door-opening operation performed on an outside handle. The sector gear, which is rotatably supported by a gear shaft, moves from a locked position to an unlocked position in response to an unlocking operation, and moves from the unlocked position to the locked position in response to a locking operation. The link lever, which is rotatably supported on an end of the opening lever, moves from a transmitting position, at which the ratchet lever is allowed to disengage the ratchet from the latch, and a non-transmitting position, at which the ratchet lever is not allowed to disengage the ratchet from the latch. One end of the anti-panic lever is rotatably supported by the gear shaft and the other end is coupled to the link lever. As the sector gear moves, the anti-panic lever causes the link lever to move to and from the transmitting position and the non-transmitting position. One end of the spring is engaged with the sector gear, and the other end of the spring is engaged with the anti-panic lever. Hence, the spring nests between the anti-panic lever and the sector gear and urges the anti-panic lever toward the sector gear.

In the conventional door lock system, when the outside handle is operated to open the door, the opening lever is moved from a non-operable position to an operable position, causing the link lever to move upward into contact with an abutting portion of the ratchet lever. This in turn moves the ratchet lever upward, and disengages the ratchet from the latch. Thus, the door can be opened with respect to a vehicle body.

When a locking operation is performed through a drive motor or the inside lock knob on the door in a closed position, the sector gear is moved from the unlocked position to the locked position, thereby pushing the anti-panic lever. Hence, the anti-panic lever is moved integrally with the sector gear, which in turn moves the link lever from a transmittable position to a non-transmittable position. Thus, the door lock system is locked.

When, in the locked state, the inside lock knob is operated in a direction to unlock the door, the sector gear is moved from the locked position to the unlocked position. This movement causes the anti-panic lever to be moved following the sector gear by a resilient force of the spring, and hence moves the link lever from the non-transmittable position to the transmittable position. Thus, the door lock system is unlocked.

When, in the locked state, the outside handle is operated to open the door while the inside lock knob is operated in the direction to unlock the door, the sector gear is moved from the locked position to the unlocked position, and the link lever comes into contact with a side face of the ratchet lever and stays at the non-transmittable position. When thereafter the outside handle is released to move the link lever downward, the resilient force of the spring moves the link lever to the transmittable position. Thus, the door lock system is unlocked. When the outside handle is operated to open the door again in this state, the door can be opened.

In the conventional door lock system having the anti-panic mechanism, the anti-panic lever is coupled between the sector gear and the link lever with the spring interposed between the sector gear and the anti-panic lever. Accordingly, the number of components is increased and the structure is complicated, which poses a problem of an increase in the man-hours required for assembly and in the manufacturing cost.

SUMMARY OF THE INVENTION

It is an object of the present invention to at least partially solve the problems in the conventional technology.

According to an aspect of the present invention, a door lock system includes a latch, a ratchet that engages with the latch, a ratchet lever that is interlocked with the ratchet and disengages the ratchet from the latch, an opening lever, a first link lever, a second link lever, and a spring. The opening lever moves from a non-operable position to an operable position in response a door-opening operation. The first link lever moves to a first position, in response to an unlocking operation, to allow the ratchet lever to disengage the ratchet from the latch, and moves to a second position, in response to a locking operation, to prevent the ratchet lever from disengaging the ratchet from the latch. The second link lever includes a cylindrical bushing that is connected to an end of the opening lever, and a ratchet driver that is formed integrally with the bushing and extends radially outward from the bushing. The ratchet driver is rotatable between a first rotational position and a second rotational position with respect to the first link lever. The ratchet driver allows, when in the first rotational position, the ratchet lever to disengage the ratchet from the latch in response to the door-opening operation that is performed on the opening lever while the first link lever is in the first position. The spring is interposed between the first link lever and the second link lever, and maintains the second link lever in the first rotational position with respect to the first link lever by a resilient force thereof when the first link lever moves from the second position to the first position.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
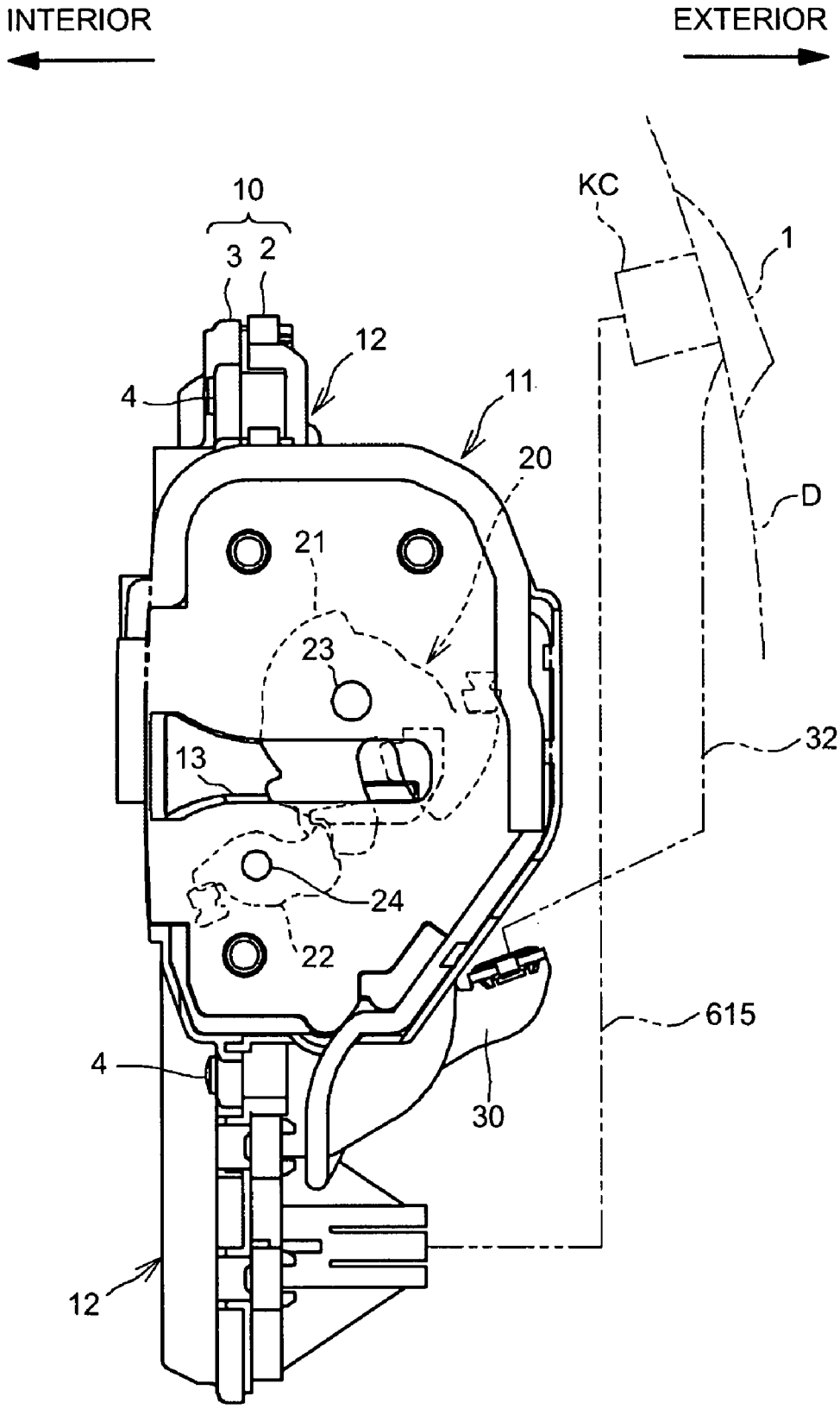
FIG. 1 is a schematic diagram of a door lock system according to an embodiment of the present invention as viewed from the rear of a vehicle.
Figure 2:
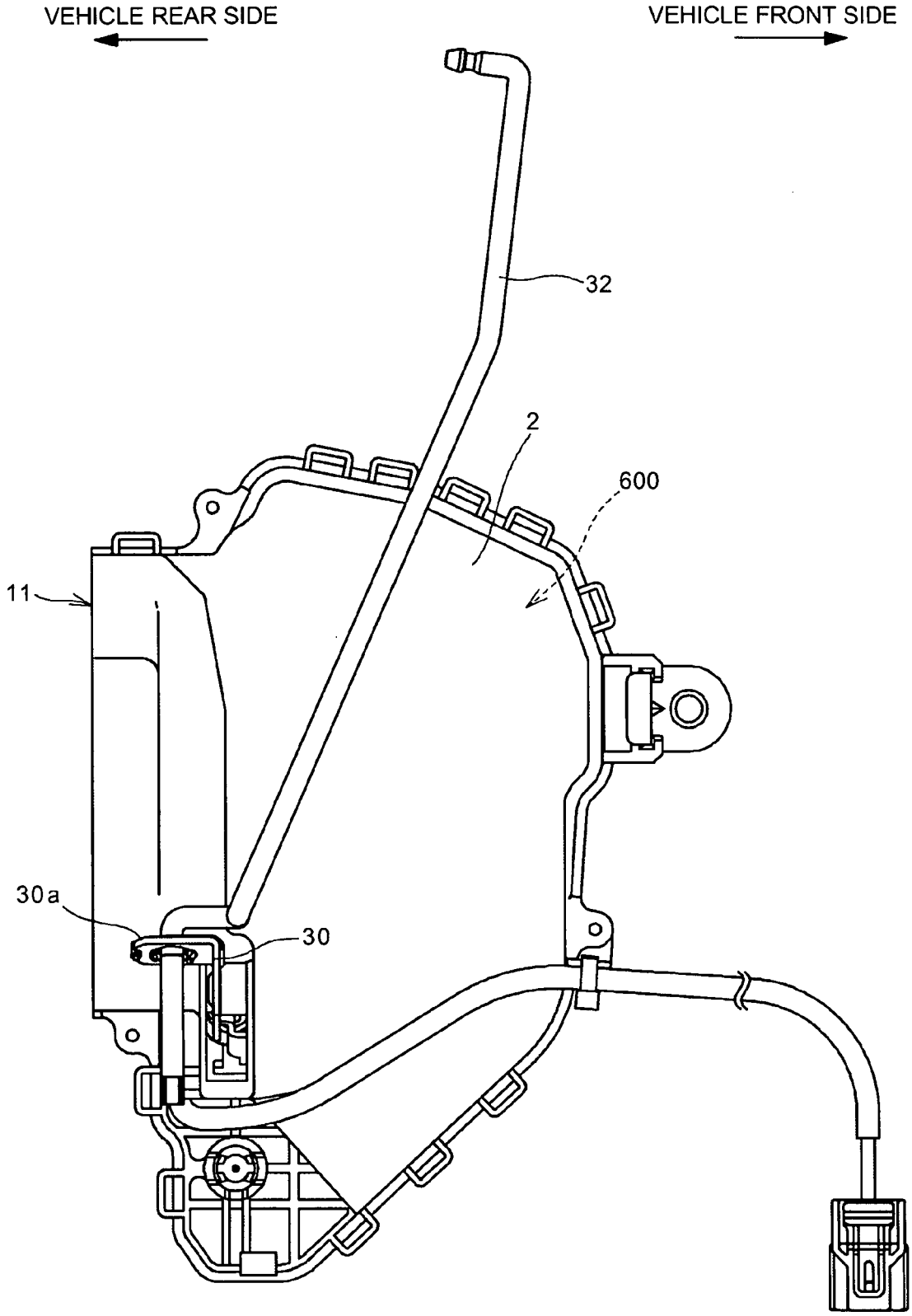
FIG. 2 is a schematic diagram of the door lock system as viewed from the exterior of the vehicle.
Figure 3:
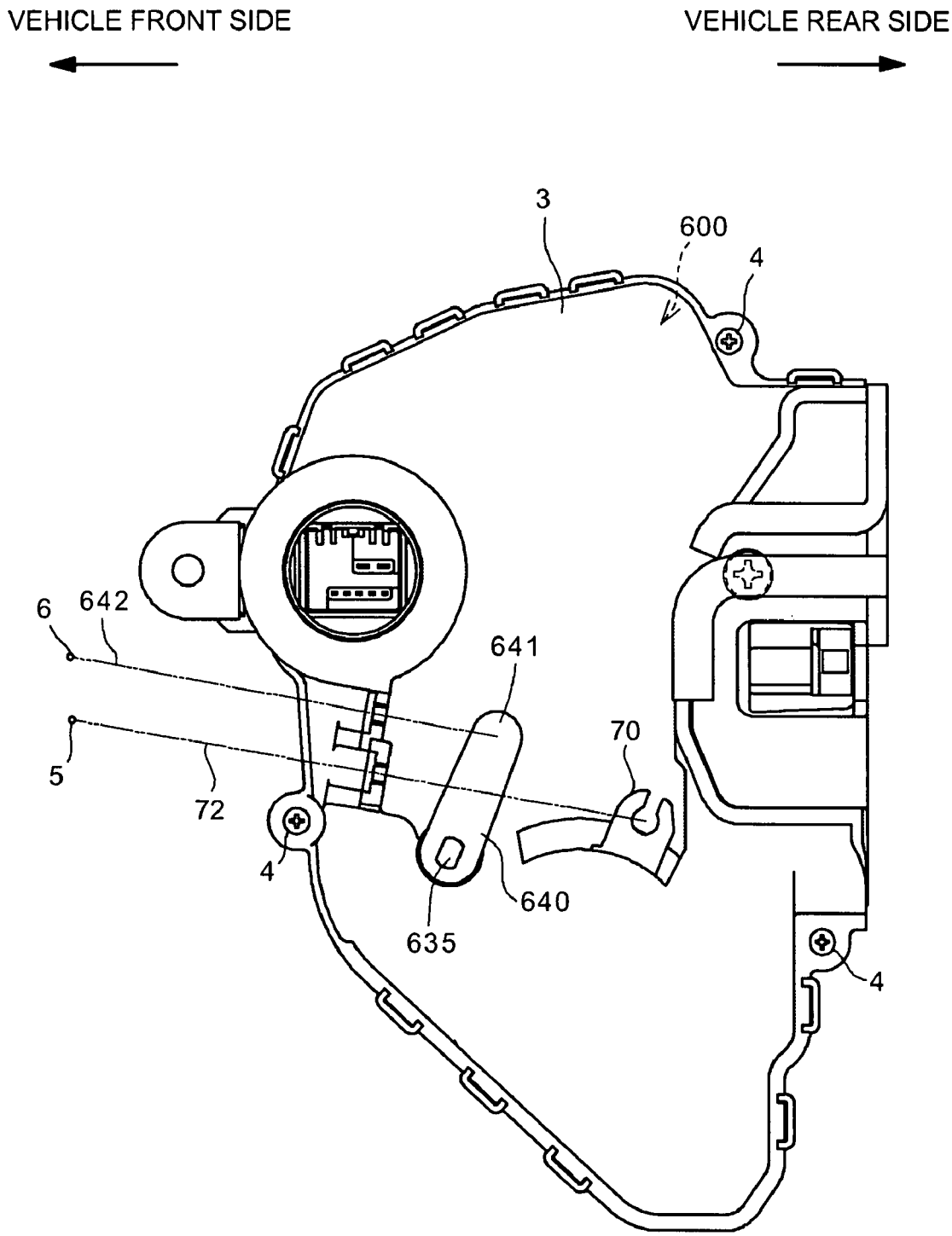
FIG. 3 is a schematic diagram of the door lock system as viewed from the interior of the vehicle.

Exemplary embodiments of the present invention are explained in detail below with reference to the accompanying drawings.

FIGS. 1 to 4 depict a door lock system according to an embodiment of the present invention. The door lock system is explained on the assumption that it is provided between an outside handle 1 and a latch mechanism 20 in a front-hinged side door on the right side of a front seat of a vehicle (a driver's door D of a right-hand drive vehicle). The door lock system includes a main casing 2 and a sub casing 3, each of which is formed from, e.g., a synthetic resin. The casings 2 and 3 are joined and fastened to each other by a fastening unit 4, such as a screw, to form a housing 10.

Figure 4:
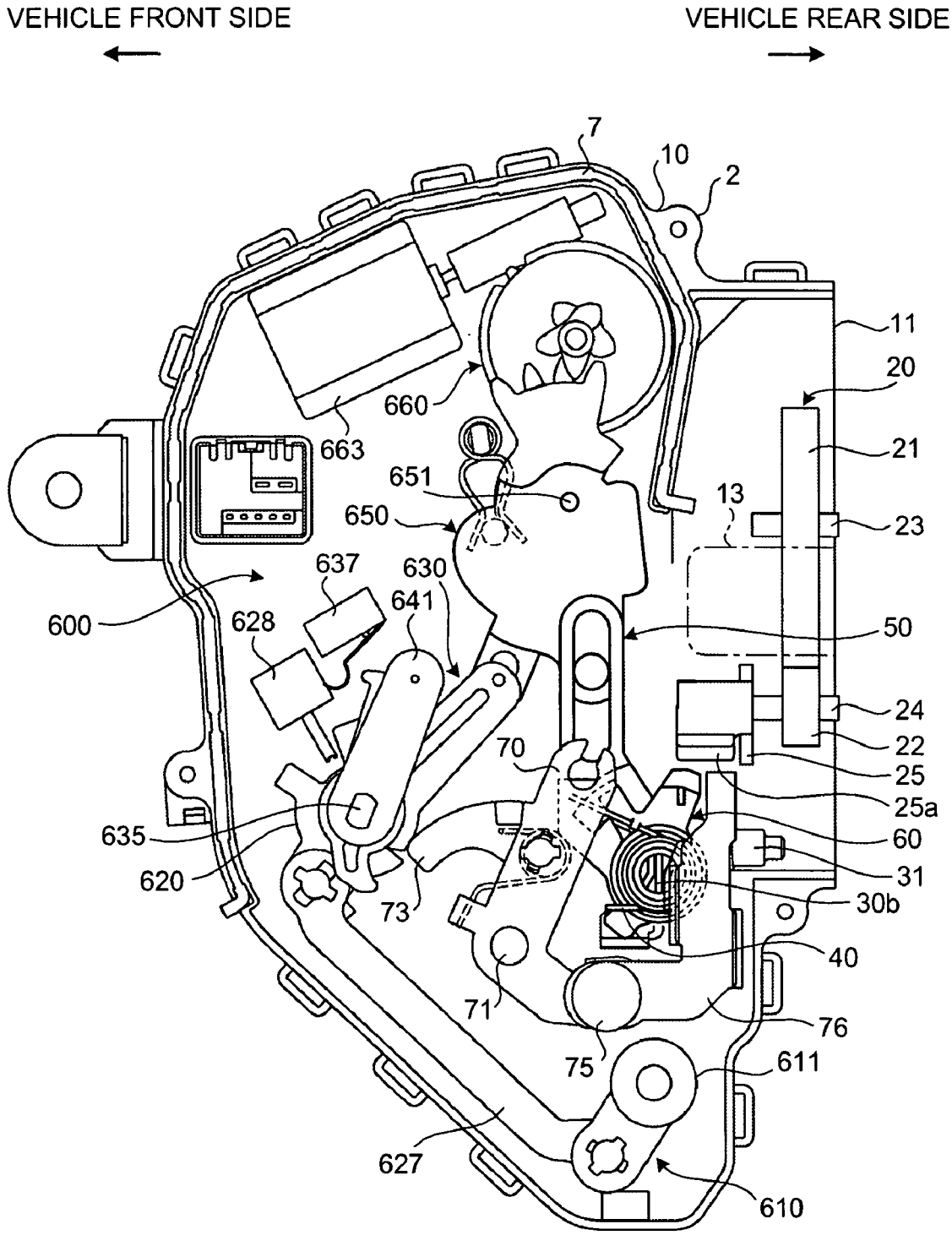
FIG. 4 is a schematic diagram of the door lock system from which a sub casing is removed as viewed from the interior of the vehicle.

The housing 10 formed with the main casing 2 and sub casing 3 includes a latch-mechanism accommodating unit 11 and a lock-mechanism accommodating unit 12. The latch-mechanism accommodating unit 11 extends in a direction traversing the door D to and from the interior and the exterior of the vehicle (hereinafter, "widthwise direction"). The lock-mechanism accommodating unit 12 extends along the door D from an interior-side end of the latch-mechanism accommodating unit 11 in the front-and-rear direction (hereinafter, "longitudinal direction") and is essentially L-shaped in its top view. As shown in FIG. 4, a gasket 7 is interposed between the main casing 2 and the sub casing 3 at their joint face that extends on the upper side of the door lock system from the front side of the vehicle to the rear side (the latch-mechanism accommodating unit 11), thereby securing desired water tightness.

The latch-mechanism accommodating unit 11 has, at its substantially heightwise midpoint, a horizontal notched groove 13 that extends essentially horizontally from the interior side to the exterior side of the vehicle, and accommodates the latch mechanism 20 therein.

Figure 5:
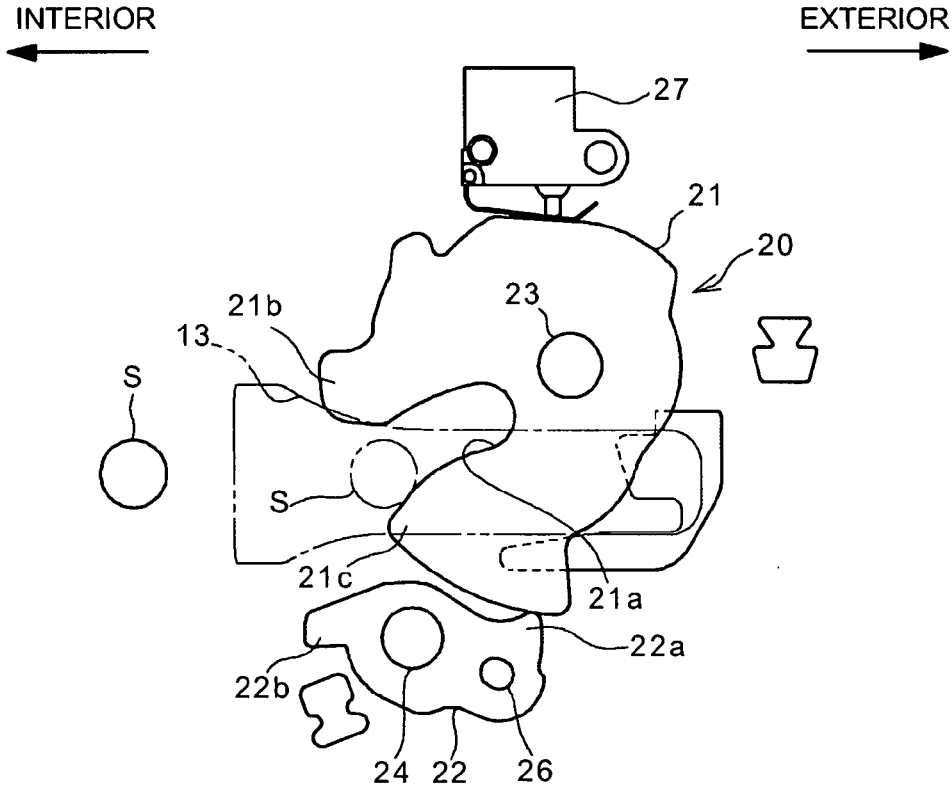
FIG. 5 is a conceptual diagram of a latch mechanism shown in FIG. 1 in an open position.
Figure 6:
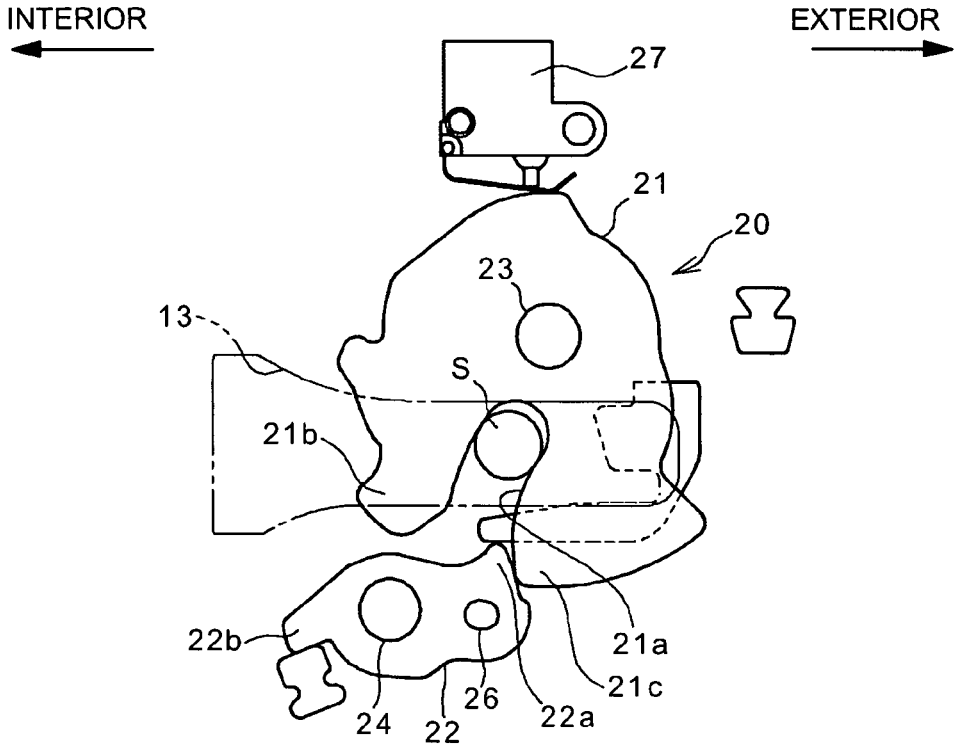
FIG. 6 is a conceptual diagram of the latch mechanism in a half-latched position.
Figure 7:
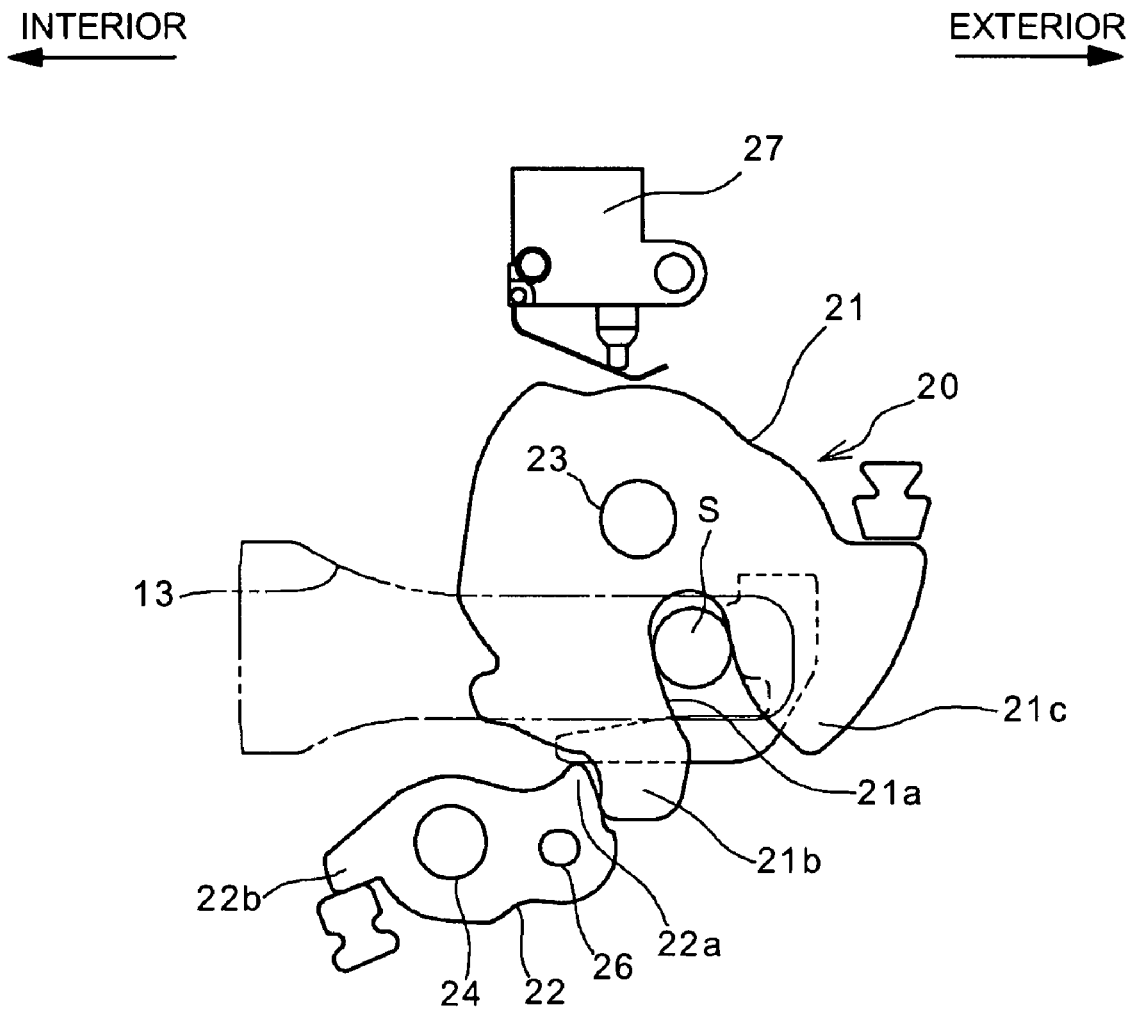
FIG. 7 is a conceptual diagram of the latch mechanism in a fully-latched position.

As in the conventional technology, the latch mechanism 20 is used for retaining a striker S on the vehicle body by latching, and includes a latch 21 and a ratchet 22 as shown in FIGS. 5 to 7.

The latch 21 is disposed at a position above the horizontal notched groove 13 of the latch-mechanism accommodating unit 11 to be rotatable about a latch shaft 23 that extends essentially horizontally in the longitudinal direction of the vehicle body. The latch 21 has an engaging groove 21*a*, a hook portion 21*b*, and a stopper portion 21*c*.

The engaging groove 21*a* is formed by grooving the latch 21 from its outer periphery radially inward toward the latch shaft 23. The engaging groove 21*a* has a width large enough to accommodate the striker S therein.

When the latch 21 is oriented such that the engaging groove 21*a* is open downward, the hook portion 21*b* of the latch 21 assumes a position closer to the interior of the vehicle than the engaging groove 21*a*. The hook portion 21*b* is formed such that, as shown in FIG. 5, when the latch 21 is rotated clockwise about the latch shaft 23, the latch 21 is stopped at a position (open position) where the horizontal notched groove 13 is open. The hook portion 21*b* is also formed such that when the latch 21 is rotated counterclockwise about the latch shaft 23, the latch 21 is stopped either at a position (fully-latched position) where the latch 21 traverses the horizontal notched groove 13 as shown in FIG. 7 or at a position (half-latched position) where the latch 21 traverses the horizontal notched groove 13 as shown in FIG. 6.

When the latch 21 is oriented such that the engaging groove 21*a* is open downward, the stopper portion 21*c* of the latch 21 assumes a position closer to the exterior of the vehicle than the engaging groove 21*a*. The stopper portion 21*c* is formed such that, as shown in FIG. 5, when the latch 21 is rotated clockwise about the latch shaft 23, the latch 21 stops while traversing the horizontal notched groove 13 and is gradually inclined upward toward the deep end (toward the exterior of the vehicle) of the horizontal notched groove 13. A latch spring (not shown) that constantly urges the latch 21 clockwise in FIGS. 5 to 7 about the latch shaft 23 is interposed between the latch 21 and the latch-mechanism accommodating unit 11.

The ratchet 22 is disposed at a position, which is below the horizontal notched groove 13 of the latch-mechanism accommodating unit 11 and closer to the interior of the vehicle than the latch shaft 23, to be rotatable about a ratchet shaft 24 that extends essentially horizontally in the longitudinal direction of the vehicle body. The ratchet 22 includes an engaging portion 22*a* and an actuating arm 22*b*.

The engaging portion 22*a* of the ratchet 22 extends radially outward with respect to the ratchet shaft 24 toward the exterior of the vehicle. When the ratchet 22 is rotated counterclockwise in FIGS. 5 to 7, the engaging portion 22*a* is engageable with the hook portion 21*b* or the stopper portion 21*c* of the latch 21 via a projecting end face on the engaging portion 22*a*. The actuating arm 22*b* of the ratchet 22 extends radially outward with respect to the ratchet shaft 24 toward the interior of the vehicle.

As shown in FIG. 4, a ratchet lever 25 is provided on the ratchet 22. The ratchet lever 25 is located forward of the ratchet 22 and supported thereon to be rotatable integrally therewith about the ratchet shaft 24. The ratchet lever 25 has an abutting portion 25*a* that extends from the ratchet shaft 24 in the same direction as the actuating arm 22*b* of the ratchet 22, and then extends forward of the vehicle (toward the lock-mechanism accommodating unit 12). A lower area of the abutting portion 25*a* is bent toward the interior of the vehicle. The ratchet lever 25 is coupled with the ratchet 22 through a coupling pin 26. A ratchet spring (not shown) that constantly urges the ratchet 22 counterclockwise in FIGS. 5 to 7 about the ratchet shaft 24 is interposed between the ratchet 22 and the latch-mechanism accommodating unit 11.

A switch 27 for detecting a position of the latch 21 is disposed above the latch 21 in the latch mechanism 20. The switch 27 includes an armature that is in sliding contact with an outer periphery of the latch 21, and detects that the latch 21 is at the fully-latched position when the switch 27 is away from the outer periphery of the latch 21. When the latch 21 is out of the fully-latched position (e.g., at the open position or the half-latched position), the switch 27 turns on a courtesy lamp (not shown) or the like.

In the latch mechanism 20, when the door D is open with respect to the vehicle body, as shown in FIG. 5, the latch 21 is in the open position with the courtesy lamp illuminated. When a door-closing operation is performed on the door D, the striker S on the vehicle body advances into the horizontal notched groove 13 of the latch-mechanism accommodating unit 11, and then the striker S comes into contact with the stopper portion 21*c* of the latch 21. As a result, the latch 21 is rotated counterclockwise in FIGS. 5 to 7 against a resilient force of the latch spring (not shown) about the latch shaft 23. Simultaneously, a resilient force of the ratchet spring (not shown) brings the projecting end face of the engaging portion 22*a* into sliding contact with the outer periphery of the latch 21. As a result, the ratchet 22 is rotated about the ratchet shaft 24 along the outer peripheral shape of the latch 21.

The further the side door D is closed from this state, the further the striker S advances into the accommodating groove 6, causing the latch 21 to further rotate counterclockwise as shown in FIG. 6. Eventually, the engaging portion 22*a* of the ratchet 22 reaches the engaging groove 21*a* in the latch 21. In this state, the stopper portion 21*c* of the latch 21 is in contact with the engaging portion 22*a* of the ratchet 22, thereby preventing the latch 21, against the resilient restoring force of the latch spring (not shown), from rotating clockwise. In addition, because the hook portion 21*b* of the latch 21 is situated to traverse the horizontal notched groove 13, the hook portion 21*b* prevents the striker S from moving in a direction away from the horizontal notched groove 13, i.e., prevents the door D from being opened (half latched) with respect to the vehicle body.

When the door D is further closed from the half-latched position, as shown in FIG. 7, the striker S advancing into the horizontal notched groove 13 causes the latch 21 to further rotate counterclockwise about the latch shaft 23 via the stopper portion 21*c*. Hence, the striker S reaches the deep end of the horizontal notched groove 13. Simultaneously, the hook portion 21*b* of the latch 21 is brought into contact with an upper face of the engaging portion 22*a*, causing the ratchet 22 to rotate clockwise in FIGS. 5 to 7 against the resilient force of the ratchet spring (not shown). Immediately after passage of the hook portion 21*b* of the latch 21, the resilient restoring force of the ratchet spring causes the ratchet 22 to rotate counterclockwise. As a result, as shown in FIG. 7, the hook portion 21*b* of the latch 21 is brought into contact with the engaging portion 22*a* of the ratchet 22. This prevents the latch 21 from rotating against the resilient restoring force of the latch spring (not shown). Also in this state, because the hook portion 21*b* of the latch 21 is situated to traverse the horizontal notched groove 13, the hook portion 21*b* prevents the striker S from moving in the direction away from the deep end of the horizontal notched groove 13. Eventually, the door D is retained in the closed position (fully latched) with respect to the vehicle body, turning off the courtesy lamp.

When, with the door D being fully latched, the actuating arm 22*b* of the ratchet 22 or the abutting portion 25*a* of the ratchet lever 25 is rotated clockwise in FIGS. 5 to 7 about the ratchet shaft 24 against the resilient force of the ratchet spring (not shown), abutting engagement between the hook portion 21*b* of the latch 21 and the engaging portion 22*a* of the ratchet 22 is released. Accordingly, the latch 21 is rotated clockwise in FIGS. 5 to 7 by the resilient restoring force of the latch spring (not shown). As a result, as shown in FIG. 5, the horizontal notched groove 13 is opened and the striker S is allowed to move in the direction away from the horizontal notched groove 13. This allows the door D to be opened with respect to the vehicle body, and turns on the courtesy lamp.

As shown in FIGS. 1 to 4, the lock-mechanism accommodating unit 21 houses an opening lever 30, a spring 40, a first link lever 50, a second link lever 60, an inner handle lever 70, and a lock mechanism 600, described later, therein.

Figure 8:
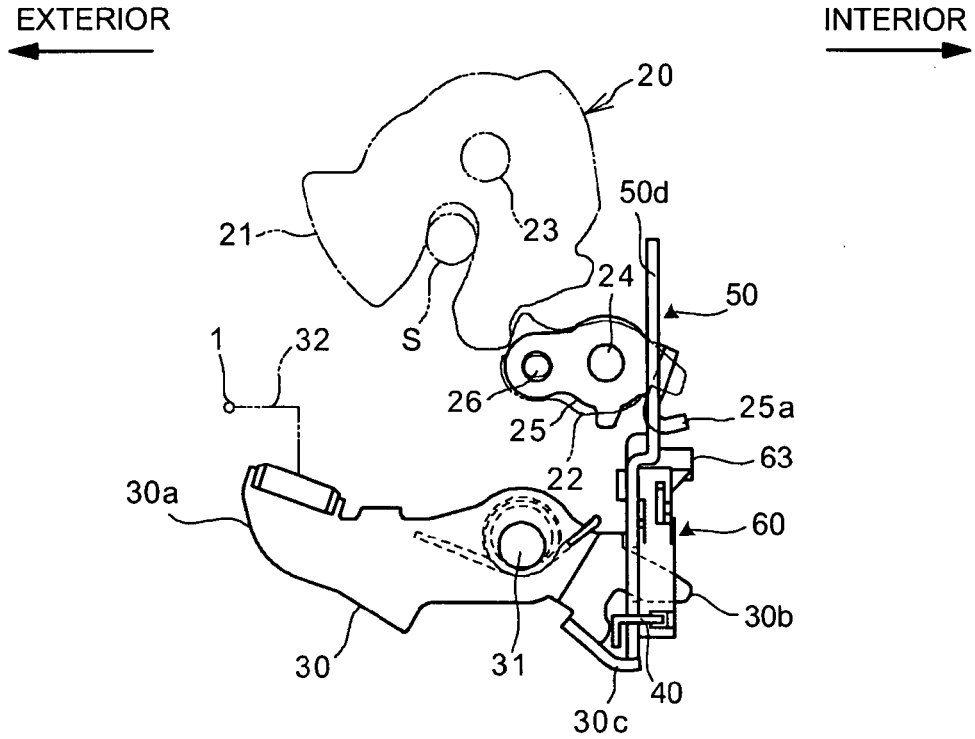
FIG. 8 is a conceptual diagram for explaining a relation between an opening lever and a set of link levers in an initial state.
Figure 9:
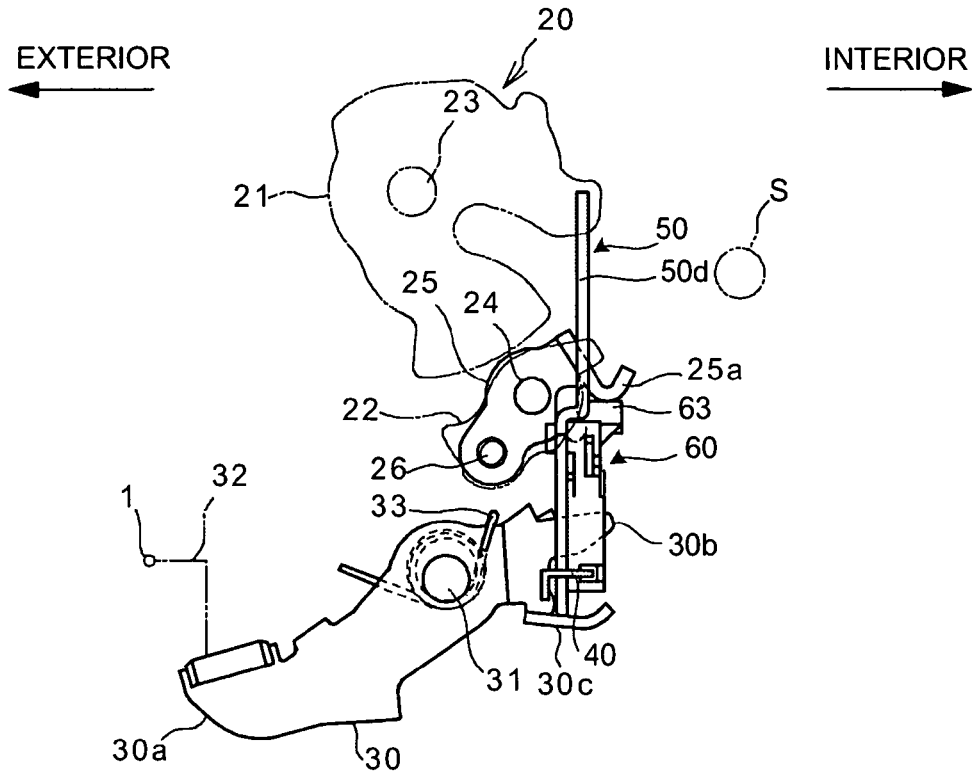
FIG. 9 is a conceptual diagram for explaining a relation between the opening lever and the link levers after a door-opening operation is performed with an outside handle.

As shown in FIGS. 8 and 9, the opening lever 30 is disposed on an opening lever shaft 31 extending essentially horizontally in the longitudinal direction of the vehicle body at a position lower than the ratchet 22 of the latch mechanism 20 to be rotatable from a non-operable position to an operable position. The opening lever 30 has an opening-actuating arm 30*a*, an opening-action arm 30*b*, and a pressure-receiving portion 30*c*.

The opening-actuating arm 30*a* of the opening lever 30 extends radially outward from the opening lever shaft 31 toward the exterior of the vehicle, and has an extended end that projects out of the housing 10. The opening-actuating arm 30*a* is connected via the projecting end to an outside handle link 32, such as a link, that is connected to the outside handle 1 on the door D. More specifically, the outside handle link 32 is connected to the outside handle link 32 such that when the outside handle 1 is operated to open the door, the opening lever 30 is rotated counterclockwise in FIG. 8 about the opening lever shaft 31.

As shown in FIG. 8, the opening-action arm 30*b* of the opening lever 30 extends radially outward from the opening lever shaft 31 toward the interior of the vehicle, and its extended end is positioned to be lower than the abutting portion 25*a* of the ratchet lever 25 inside the housing 10.

The pressure-receiving portion 30*c* is a portion of the opening lever 30 positioned to be lower than the opening-action arm 30*b* and forwardly bent from a lower edge of the opening lever 30. An opening lever spring 33 that constantly urges the opening lever 30 clockwise in FIG. 8 about the opening lever shaft 31 is interposed between the opening lever 30 and the lock-mechanism accommodating unit 12.

Figure 20:
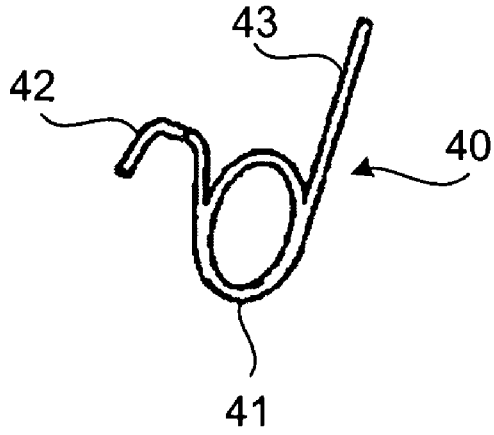
FIG. 20 is a perspective view of a spring.

The spring 40 is housed in the second link lever 60, described later. FIG. 20 is a perspective view of the spring 40. The spring 40 includes a ring portion 41, and leg portions 42 and 43.

Figure 21:
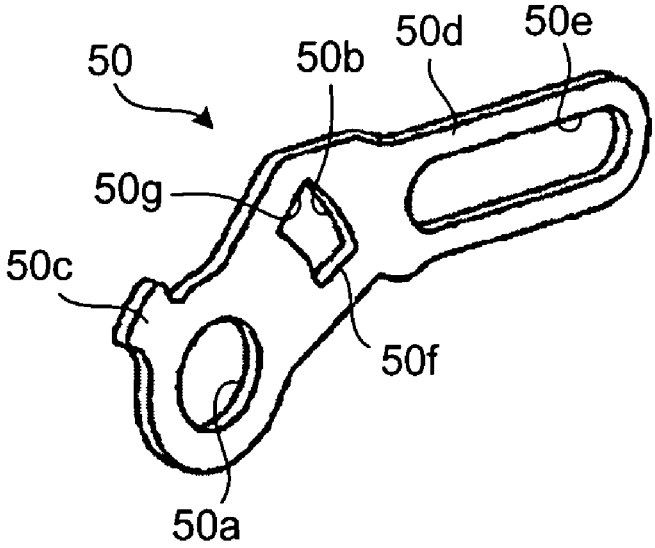
FIG. 21 is a perspective view of a first link lever.

As shown in FIGS. 8 and 9, the first link lever 50 is attached to the opening-action arm 30*b* to be positioned on an imaginary plane perpendicular to the opening lever 30. The first link lever 50 is supported by the opening lever 30 to be vertically movable integrally with the opening-action arm 30*b* and pivotable about an axis extending in the widthwise direction of the vehicle body. More specifically, when the unlocking operation is performed, the first link lever 50 is moved to the transmitting position, at which the ratchet lever 25 can perform disengaging, whereas when the locking operation is performed, the first link lever 50 is moved to the non-transmitting position, at which the ratchet lever 25 cannot perform disengaging. FIG. 21 is a perspective view of the first link lever 50. The first link lever 50 includes an attachment hole 50*a*, an opening 50*b*, a spring engaging portion 50*c*, and a locking-lever coupling portion 50*d*.

The attachment hole 50*a* in the first link lever 50 has a diameter greater than that of a bushing 61 of the second link lever 60, described later. The attachment hole 50*a* receives the opening-action arm 30*b* to pass through the attachment hole 50*a* with the bushing 61 of the second link lever 60 interposed therebetween.

The opening 50*b* is formed in the first link lever 50 at a portion higher than the attachment hole 50*a*, and has side walls 50*f* and 50*g*. The opening 50*b* is formed such that a projection 64*a* on a first-link-lever abutting portion 64 on the second link lever 60, described later, is inserted into the opening 50*b* to allow the projection 64*a* to move within the opening 50*b*.

The spring engaging portion 50*c* projects out of a side face of the first link lever 50 at a portion near the attachment hole 50*a* of the first link lever 50. The spring engaging portion 50*c* is used for engagement with a tip end of the leg portion 42 of the spring 40.

The locking-lever coupling portion 50*d* is positioned at a portion of the first link lever 50 higher than the opening 50*b* and extends upward with respect to the axis of the attachment hole 50*a*. A vertically-elongated coupling slot 50*e* is formed in the locking-lever coupling portion 50*d*. A locking lever 650, described later, is coupled to the coupling portion 50*d*. Hence as the locking lever 650 is moved, the first link lever 50 is moved between the transmitting position, at which a door-opening operation is transmitted to the ratchet, and the non-transmitting position, at which the door-opening operation is not transmitted to the ratchet.

Figure 22:
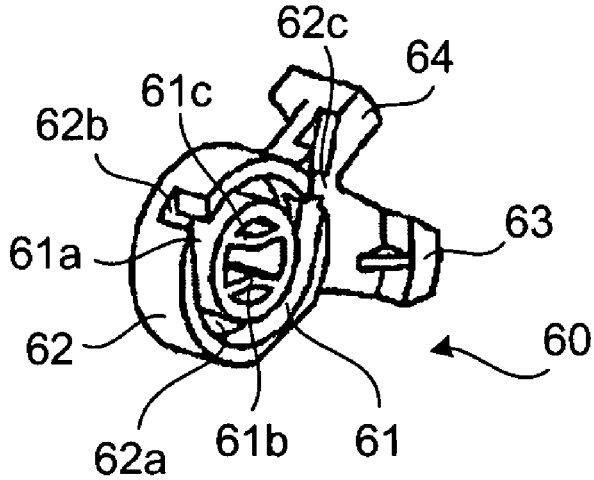
FIG. 22 is a perspective view of a second link lever.

As shown in FIGS. 8 and 9, the second link lever 60 is attached to the opening-action arm 30*b* to be positioned on the imaginary plane perpendicular to the opening lever 30 as in the case of the first link lever 50. FIG. 22 is a perspective view of the second link lever 60. The second link lever 60 is formed from a synthetic resin, and includes the bushing 61, a spring receptacle 62, a ratchet driver 63, and the first-link-lever abutting portion 64 integrally therewith. As shown in FIGS. 8 and 9, the bushing 61 of the second link lever 60 is connected with the opening-action arm 30*b* of the opening lever 30 such that the second link lever 60 is supported by the opening-action arm 30*b* to be vertically movable therewith and rotatable about an axis extending in the widthwise direction of the vehicle body.

The bushing 61 of the second link lever 60 includes a cylindrical portion 61*a* and wall portions 61*b* and 61*c*. A hole through which the opening-action arm 30*b* of the opening lever 30 passes is formed in the cylindrical portion 61*a*. Although not clearly shown in the drawings, the widthwise length of the cylindrical portion 61*a* on the side extending toward the exterior of the vehicle is greater than that of the spring receptacle 62. This geometry allows the second link lever 60 to be rotatably supported via the cylindrical portion 61*a* by the first link lever 50 about its axis and inserted into the opening-action arm 30*b*. Each of the wall portions 61*b* and 61*c* is formed inside the hole in the cylindrical portion 61*a* and inclined to have a diameter that gradually increases radially outward. The wall portions 61*b* and 61*c* limit rotation ranges of the first link lever 50 and the second link lever 60 in relation to the opening-action arm 30*b*.

The spring receptacle 62 of the second link lever 60 is used for housing the spring 40 therein, and has a cylindrical shape to house the bushing 61 therein. The spring receptacle 62 includes a recess 62*a*, a groove 62*b*, and an engaging projection 62*c* between an inner wall of the spring receptacle 62 and the cylindrical portion 61*a* of the bushing 61. The ring portion 41 of the spring 40 is housed in the recess 62*a*. The leg portion 42 of the spring 40 is disposed in the groove 62*b*, and the tip end of the leg portion 42 is engaged with the spring engaging portion 50*c* of the first link lever 50. The leg portion 43 of the spring 40 is engaged with the engaging projection 62*c*.

The ratchet driver 63 of the second link lever 60 extends radially outward with respect to the axis of the bushing 61 toward the abutting portion 25*a* of the ratchet lever 25. The ratchet driver 63 is formed so that the ratchet lever 25 can press against the abutting portion 25*a* when the second link lever 60 is moved upward by the door-opening operation.

The first-link-lever abutting portion 64 of the second link lever 60 extends upward from the axis of the bushing 61 and nests adjacent to the ratchet driver 63. The projection 64*a* that projects toward the exterior of the vehicle is formed on a tip end of the first-link-lever abutting portion 64.

Figure 23:
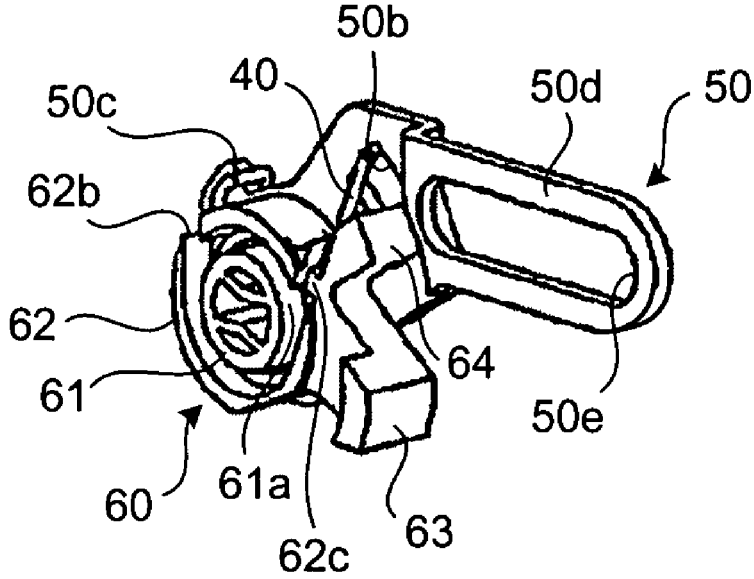
FIG. 23 is a perspective view of the spring, the first link lever, and the second link lever in an assembled state.

FIG. 23 is a perspective view of the spring 40, the first link lever 50, and the second link lever 60 in an assembled state. As shown in FIG. 23, the leg portion 42 of the spring 40 is engaged with the spring engaging portion 50*c* of the first link lever 50, and the leg portion 43 of the spring 40 is engaged with the engaging projection 62*c* of the first link lever 50. Hence, the second link lever 60 is urged such that the projection 64*a* of the second link lever 60 comes into contact with the side wall 50*f* of the opening 50*b* in the first link lever 50. As shown in FIG. 4, the second link lever 60 is situated at a predetermined rotational position about the axis of the bushing 61 relative to the first link lever 50. More specifically, the second link lever 60 is situated such that the ratchet driver 63 can be brought into contact with the abutting portion 25*a* of the ratchet lever 25 when the projection 64*a* of the second link lever 60 is in contact with the side wall 50*f* of the opening 50*b* in the first link lever 50. Hereinafter, the position at which the ratchet driver 63 is located with the projection 64*a* of the second link lever 60 being in contact with the side wall 50*f* of the opening 50*b* is referred to as a "first rotational position".

Figure 10:
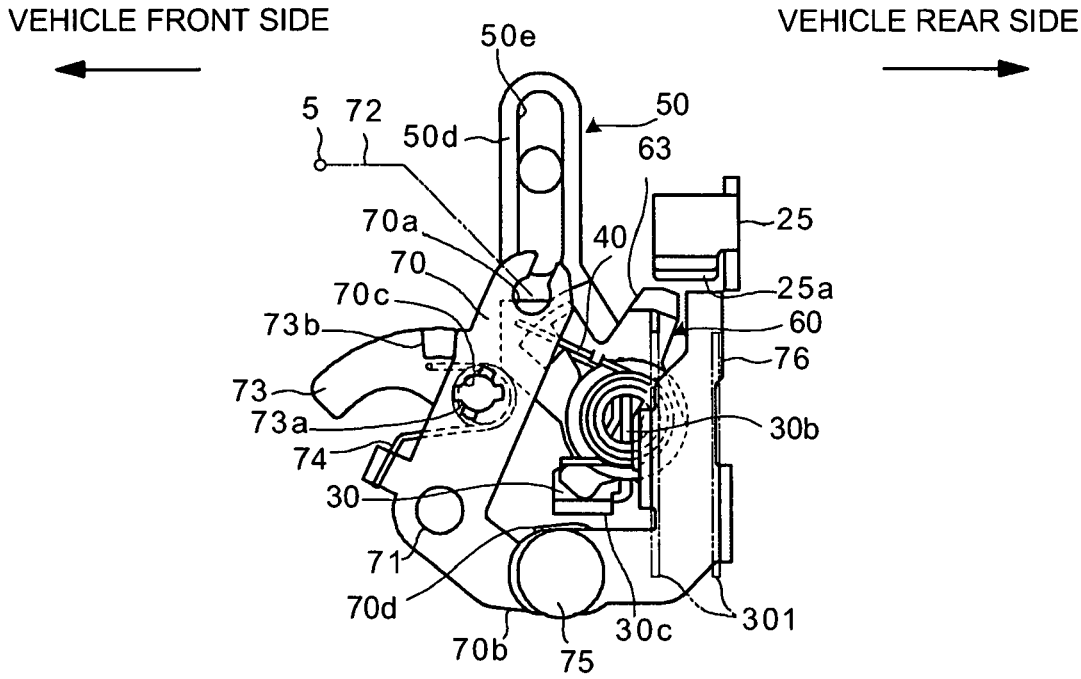
FIG. 10 is a conceptual diagram for explaining a relation between an inner handle lever and the link levers in the initial state.
Figure 11:
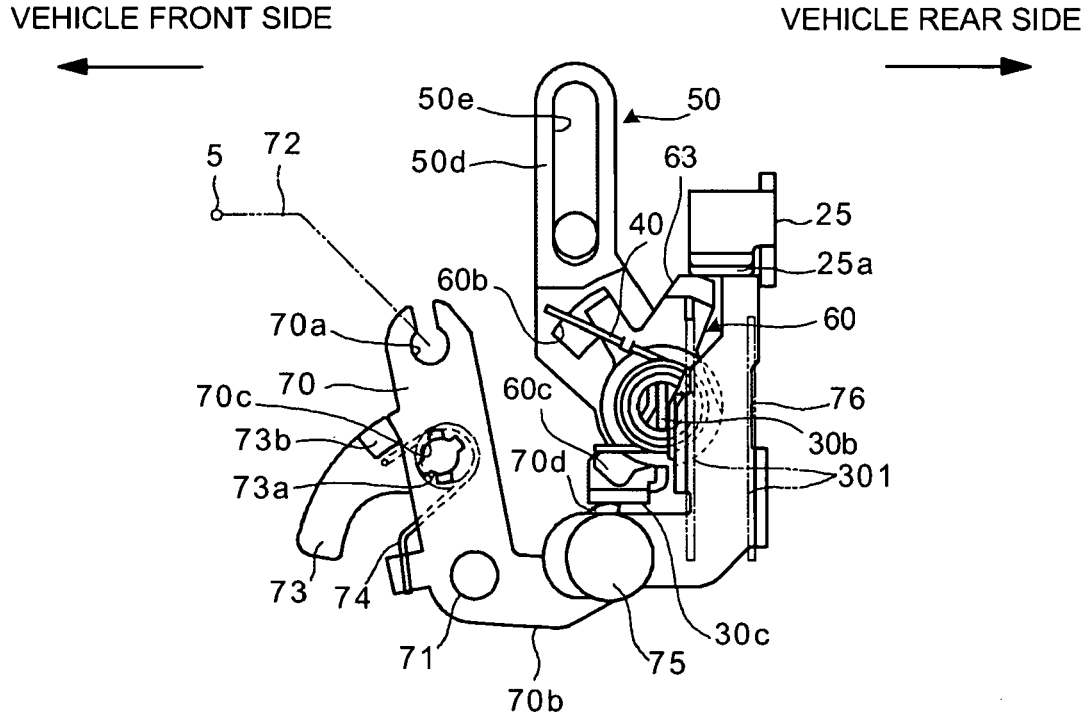
FIG. 11 is a conceptual diagram for explaining a relation between the inner handle lever and the link levers after a door-opening operation is performed with an inside handle.

As shown in FIGS. 10 and 11, the inner handle lever 70 is attached to a lower portion of the opening lever 30 to be pivotable via an inner lever shaft 71 that extends essentially horizontally in the widthwise direction of the vehicle body. The inner handle lever 70 includes an inner actuating arm 70*a* and an action arm 70*b*.

The inner actuating arm 70*a* extends upward from the inner lever shaft 71, and has an extended end that projects out of the housing 10. Of the inner actuating arm 70*a*, the end portion projecting out of the housing 10 is connected to an inside handle link 72, such as a link or wire, that connects between the inner actuating arm 70*a* and the inside handle 5 on the interior side of the door D. More specifically, the inside handle link 72 is connected to the inner actuating arm 70*a* such that when the inside handle 5 is operated to open the door, the inner handle lever 70 is pivoted counterclockwise in FIGS. 10 and 11 about the inner lever shaft 71.

A single-motion lever coupling hole 70*c* is formed in a portion halfway of the inner actuating arm 70*a* in its elongated direction. A single-motion lever 73 is engaged with the single-motion lever coupling hole 70*c*. The single-motion lever 73 extends toward the front of the vehicle from the inner actuating arm 70*a* to assume an arc shape concentric with the inner lever shaft 71. The single-motion lever 73 has a shaft portion 73*a* and an abutting portion 73*b* on its base end. The shaft portion 73*a* is rotatably attached to the inner actuating arm 70*a* at the single-motion lever coupling hole 70*c*. The abutting portion 73*b* is to be brought into contact with a side face of the inner actuating arm 70*a*. A single-motion spring 74 that urges the abutting portion 73*b* of the single-motion lever 73 into contact with the side face of the inner actuating arm 70*a* is interposed between the single-motion lever 73 and the inner actuating arm 70*a*.

The action arm 70*b* of the inner handle lever 70 extends from the inner lever shaft 71 in a downwardly inclined manner toward the rear of the vehicle. A single-motion link 76 is attached through a rivet 75 to the action arm 70*b* to be movable upward. A portion of the action arm 70*b* is bent toward the exterior of the vehicle as a pressing portion 70*d*. When the inner handle lever 70 is pivoted counterclockwise in FIGS. 10 and 11 about the inner lever shaft 71, the pressing portion 70*d* comes into contact with the pressure-receiving portion 30*c* of the opening lever 30 and presses it upward.

When the inner handle lever 70 is pivoted counterclockwise in FIGS. 10 and 11 about the inner lever shaft 71, the single-motion link 76 comes into contact with the abutting portion 25*a* of the ratchet lever 25 and presses it upward. The single-motion link 76 is formed into an essentially L-shape, and extends radially outward toward the rear of the vehicle from the rivet 75 and then upward toward the abutting portion 25*a* of the ratchet lever 25.

A coupling slot (not shown) elongated in the longitudinal direction is formed in the base end of the single-motion link 76. The rivet 75 is engaged with the coupling slot with play left for allowing sliding. As shown by alternate long and two short dashes lines in FIGS. 10 and 11, a set of guides 301 is formed on the sub casing to guide a portion of the single-motion link 76, the portion extending toward the abutting portion 25*a*, for vertical movement.

The lock mechanism 600 is switched between an unlocked state, under which rotation of the opening lever 30 resulting from the door-opening operation performed using the outside handle 1 is transmitted to the latch mechanism 20, and a locked state, under which rotation of the opening lever 30 resulting from the door-opening operation performed using the outside handle 1 is not transmitted to the latch mechanism 20. As shown in FIG. 4, the lock mechanism 600 has a key lever 610, a key sub lever 620, a connecting lever 630, the locking lever 650, and a worm wheel 660 on the surface of the main casing 2 facing the sub casing 3, that is, the surface of the main casing 2 covered with the sub casing 3.

Figure 12:
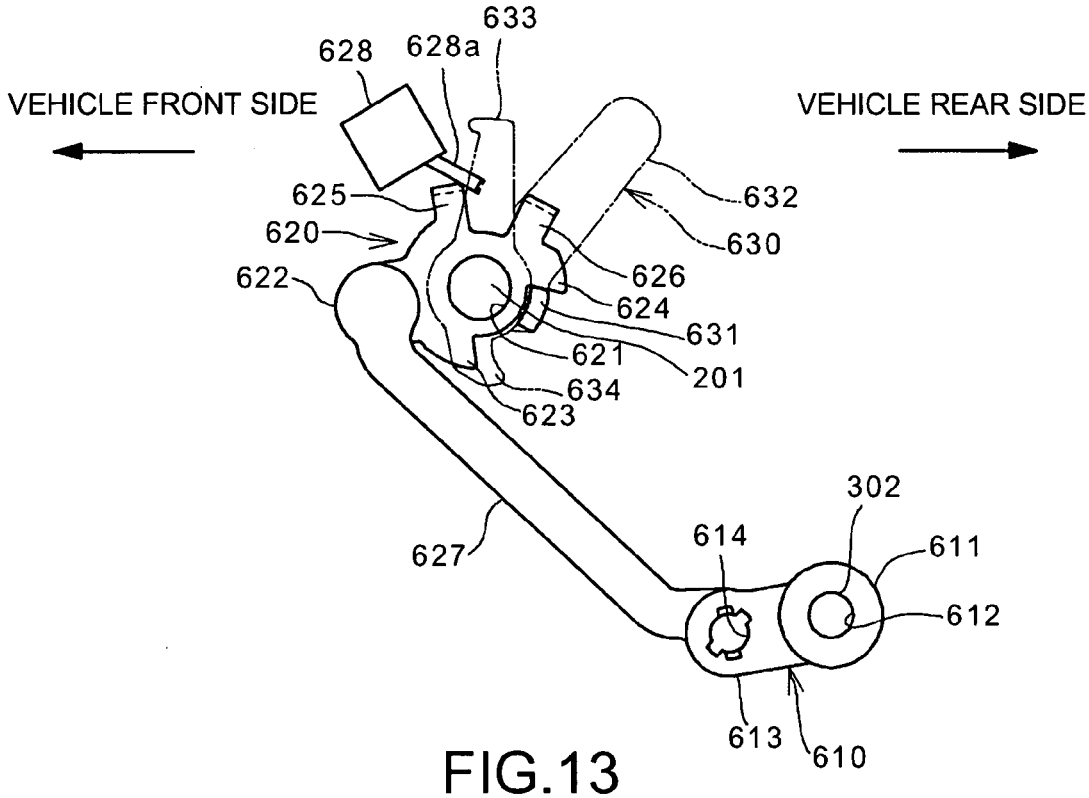
FIG. 12 is a conceptual diagram of a lock mechanism unlocked by a key operation.
Figure 13:
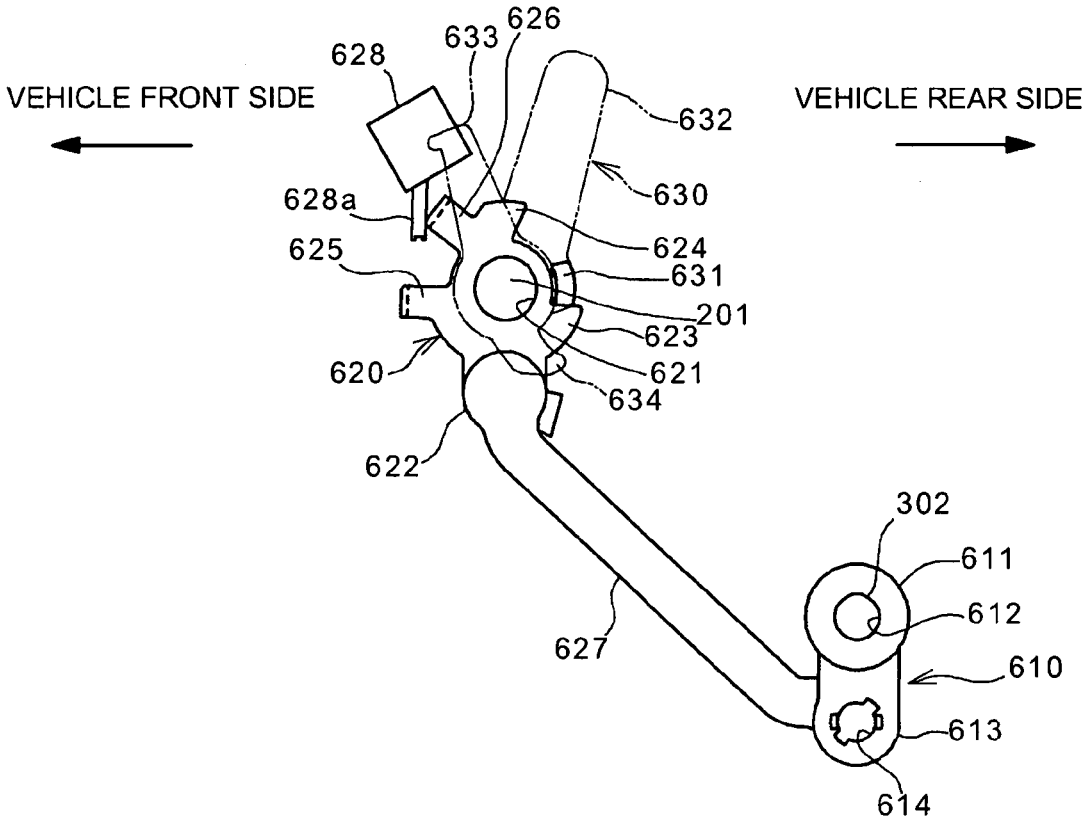
FIG. 13 is a conceptual diagram of the lock mechanism locked by a key operation.

The key lever 610 is rotatably disposed at a position below the housing 10. As shown in FIGS. 12 and 13, the key lever 610 has an input shaft portion 611, a rotation support recess 612, and a lever portion 613.

The input shaft portion 611 of the key lever 610 receives an input of a rotary driving force applied when the key cylinder KC in the door D is turned using a key. The input shaft portion 611 is connected to a key cylinder link 615 (see FIG. 1), such as a link or a cable, that transmits the rotary driving force from the key cylinder KC resulting from a key operation using the key. More specifically, the key cylinder link 615 is connected to the input shaft portion 611 such that when the key cylinder KC is operated in a direction to lock the door, the key lever 610 is rotated counterclockwise in FIGS. 12 and 13, and when the key cylinder KC is operated in a direction to unlock the door, the key lever 610 is rotated clockwise in FIGS. 12 and 13.

The rotation support recess 612 of the key lever 610 is formed in the input shaft portion 611. The rotation support recess 612 receives a projection 302 formed on the sub casing 3 in a fitting manner, thereby rotatably supporting the key lever 610.

The lever portion 613 of the key lever 610 extends radially outward with respect to the input shaft portion 611. A key-link coupling hole 614 is formed in an extended end of the lever portion 613.

As shown in FIGS. 12 and 13, the key sub lever 620 is rotatably disposed above and forward of the key lever 610 in the vehicle. The key sub lever 620 includes a rotation support hole 621, a key-link coupling unit 622, a locking switch lug 623, an unlocking switch lug 624, a locking-operation detecting lug 625, and an unlocking-operation detecting lug 626.

The projection 201 on the main casing 2 extending into the housing 10 (the interior side of the vehicle body) is inserted through the rotation support hole 621 in the key sub lever 620. Hence, the rotation support hole 621 receives the key sub lever 620 rotatably about the projection 201 in FIGS. 12 and 13.

The key-link coupling unit 622 of the key sub lever 620 extends radially outward with respect to the axis of the rotation support hole 621 (the projection 201). A key-link coupling hole 622*a* (see FIG. 14) is formed in the tip end of the key-link coupling unit 622. The key-link coupling hole 622*a* and the key-link coupling hole 614 in the key lever 610 are coupled together by a key link 627. In other words, rotary motion of the key lever 610 can be transmitted to the key sub lever 620 via the key link 627.

Each of the locking switch lug 623 and the unlocking switch lug 624 on the key sub lever 620 extends radially outward with respect to the axis of the rotation support hole 621. The locking switch lug 623 switches the lock mechanism 600 from the unlocked state to the locked state in response to rotation of the key sub lever 620. On the other hand, the unlocking switch lug 624 switches the lock mechanism 600 from the locked state to the unlocked state in response to rotation of the key sub lever 620.

Each of the locking-operation detecting lug 625 and the unlocking-operation detecting lug 626 on the key sub lever 620 extends radially outward with respect to the axis of the rotation support hole 621. When the key sub lever 620 is moved from the unlocked position to the locked position, the locking-operation detecting lug 625 toggles a detecting piece 628*a* of a switch 628 counterclockwise. On the other hand, when the key sub lever 620 is moved from the locked position to the unlocked position, the unlocking-operation detecting lug 626 toggles the detecting piece 628*a* of the switch 628 clockwise. Thus, the locking-operation detecting lug 625 and the unlocking-operation detecting lug 626 actuate the detecting piece 628*a* of the switch 628 for discrimination among operations performed using the key via the key cylinder KC, i.e., discrimination between the locking operation and the unlocking operation.

Figure 14:
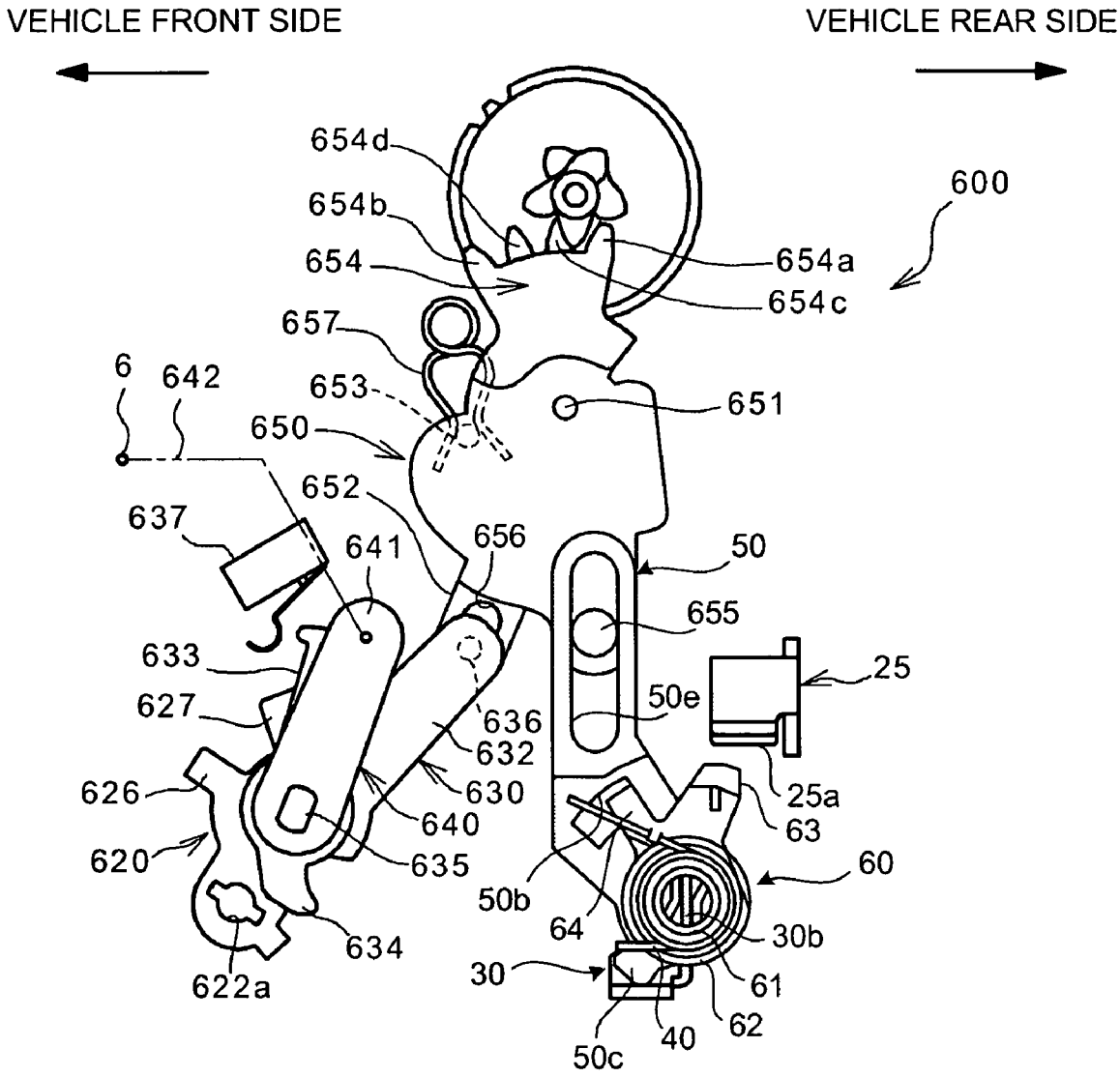
FIG. 14 is a conceptual diagram of the lock mechanism with a locking lever in an unlocked position.

As shown in FIG. 14, the connecting lever 630 is attached to the key sub lever 620 rotatably about the axis of the rotation support hole 621. The connecting lever 630 has a switching lug 631, a locking-lever coupling portion 632, a switching lever 633, a single-motion lug 634, and a rotary shaft portion 635.

The switching lug 631 is used for moving the connecting lever 630 from an unlocked position to a locked position, and vise versa. The switching lug 631 is formed on the face of the connecting lever 630 facing the key sub lever 620. More specifically, the switching lug 631 can be brought into contact with the locking switch lug 623 and the unlocking switch lug 624 on the key sub lever 620. When the switching lug 631 comes into contact with the locking switch lug 623 to thus be pressed by the same, the connecting lever 630 is moved from the unlocked position to the locked position. On the other hand, when the switching lug 631 comes into contact with the unlocking switch lug 624 to thus be pressed by the same, the connecting lever 630 is moved from the locked position to the unlocked position.

The locking-lever coupling portion 632 of the connecting lever 630 extends radially outward with respect to a rotation center of the connecting lever 630. The locking-lever coupling portion 632 includes, at its extended end, a coupling projection 636. The coupling projection 636 extends from an exterior-side face of the tip end of the locking-lever coupling portion 632 essentially horizontally in the widthwise direction of the vehicle body.

The switching lever 633 is used for detecting a position of the connecting lever 630. The switching lever 633 toggles off a switch 637 when the connecting lever 630 is in the unlocked position (see FIG. 14). On the other hand, the switching lever 633 toggles on the switch 637 when the connecting lever 630 is moved to the locked position (see FIG. 15).

The single-motion lug 634 comes into contact with single-motion lever 73 to thereby switch the lock mechanism 600 in the locked state to the unlocked state. The single-motion lug 634 extends radially from the rotation center of the connecting lever 630 such that when the lock mechanism 600 is in the locked state, the single-motion lug 634 is at a position where the single-motion lug 634 can be brought into contact with the single-motion lever 73, whereas when the lock mechanism 600 is in the locked state, the single-motion lug 634 is at a position where the lug 634 cannot be brought into contact with the single-motion lever 73.

The rotary shaft portion 635 of the connecting lever 630 supports the connecting lever 630 rotatably with respect to the sub casing 3. The rotary shaft portion 635 extends from the connecting lever 630 integrally therewith, and has an end that projects out of the housing 10 through the sub casing 3. As shown in FIG. 4, the rotary shaft portion 635 is disposed in a relatively lower area below electrical components, such as the switches 628 and 637 and a drive motor 673 inside the housing 10, described later, in the housing 10.

An external-force transmitting lever 640 is fixedly attached to the projecting end of the rotary shaft portion 635. The external-force transmitting lever 640 rotates integrally with the connecting lever 630 as a unit. More specifically, when the connecting lever 630 is moved from the locked position to the unlocked position, the external-force transmitting lever 640 is moved from the locked position to the unlocked position, whereas when the connecting lever 630 is moved from the unlocked position to the locked position, the external-force transmitting lever 640 is moved from the unlocked position to the locked position. Meanwhile, when the external-force transmitting lever 640 is moved from the unlocked position to the locked position, the connecting lever 630 is moved from the unlocked position to the locked position, whereas when the external-force transmitting lever 640 is moved from the locked position to the unlocked position, the connecting lever 630 is moved from the locked position to the unlocked position.

The external-force transmitting lever 640 includes a lock-knob coupling portion 641. The lock-knob coupling portion 641 corresponds to the tip end of the external-force transmitting lever 640 that extends radially outward from the rotary shaft portion 635 of the connecting lever 630. A lock knob link 642, such as a link or wire, that connects between the lock-knob coupling portion 641 and an inside lock knob 6, which is provided on the interior side of the door D, is connected to the lock-knob coupling portion 641. More specifically, when the inside lock knob 6 is operated in the direction to lock the door, the driving force of the operation is transmitted to the external-force transmitting lever 640 via the lock-knob coupling link 642, causing the external-force transmitting lever 640 to rotate counterclockwise in FIG. 14 and hence rotating the rotary shaft portion 635 counterclockwise. On the other hand, when the inside lock knob 6 is operated in the direction to unlock the door, the driving force of the operation is transmitted to the external-force transmitting lever 640 via the lock-knob coupling link 642, causing the external-force transmitting lever 640 to rotate clockwise in FIG. 15 and hence rotating the rotary shaft portion 635 clockwise. Thus, the driving force applied to operate the inside lock knob 6 from outside of the housing 10 is transmitted to the external-force transmitting lever 640 via the lock-knob link 642, and received by the rotary shaft portion 635, which functions as an input section. Upon receipt of the driving force from outside of the housing 10, the rotary shaft portion 635 switches the lock mechanism 600 between the unlocked state and the locked state.

As shown in FIG. 14, the locking lever 650 is rotatably disposed on a gear shaft 651 that extends essentially horizontally in the widthwise direction of the vehicle body. The locking lever 650 includes a connecting-lever coupling portion 652, a state-maintaining protrusion 653, a driven gear 654, and a link-lever coupling projection 655.

The connecting-lever coupling portion 652 of the locking lever 650 extends radially outward with respect to the gear shaft 651. A coupling slot 656 is formed in the connecting-lever coupling portion 652. The coupling slot 656 allows the coupling projection 636 to pass therethrough. More specifically, counterclockwise pivoting in FIG. 14 of the connecting lever 630 causes the locking lever 650 to pivot about the gear shaft 651 clockwise, whereas clockwise pivoting of the connecting lever 630 causes the locking lever 650 to pivot about the gear shaft 651 counterclockwise.

Figure 15:
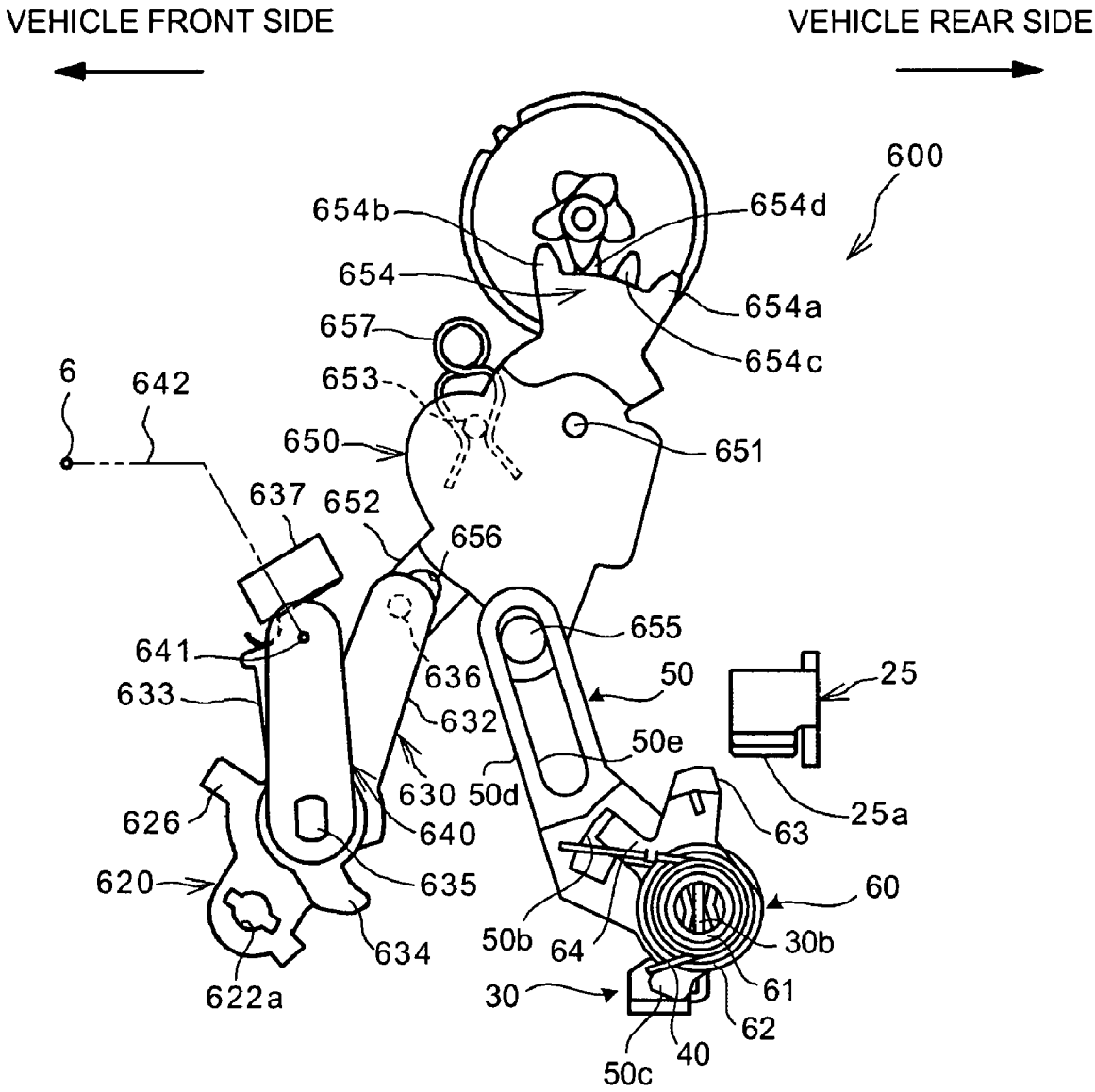
FIG. 15 is a conceptual diagram of the lock mechanism with the locking lever in a locked position.

The state-maintaining protrusion 653 is used for maintaining the locking lever 650 at a rotational position. The state-maintaining protrusion 653 protrudes from a face of the locking lever 650 facing the main casing 2 essentially horizontally in the widthwise direction of the vehicle body. The state-maintaining protrusion 653 is clamped by a spring 657 attached to the main casing 2, thereby maintaining either the unlocked state (FIG. 14) or the locked state (FIG. 15).

As shown in FIG. 14, the driven gear 654 of the locking lever 650 is formed into a shape of a sector concentric with the gear shaft 651. The driven gear 654 includes a pair of outer teeth 654*a* and 654*b*, a first driven tooth 654*c*, and a second driven tooth 654*d*. The outer teeth 654*a* and 654*b*, the first driven tooth 654*c*, and the second driven tooth 654*d* are arranged along an extending direction of the gear shaft 651 at three levels which differ from each other in terms of height. The outer teeth 654*a* and 654*b* are disposed on opposite sides of the driven gear 654 at positions closest to the interior of the vehicle. The first driven tooth 654*c* is disposed at a position between the outer teeth 654*a* and 654*b*, the position being close to the one outside tooth 654*a* as well as being a midpoint in the extending direction of the gear shaft 651. The second driven tooth 654*d* is disposed at a position between the other outer tooth 654*b* and the first driven tooth 654*c*, the position being closest to the exterior of the vehicle.

The link-lever coupling projection 655 projects essentially horizontally in the widthwise direction of the vehicle body from an interior-side face of the tip end of the locking lever 650. The link-lever coupling projection 655 is engaged with the elongated coupling slot 50*e* in the first link lever 50.

Figure 18:
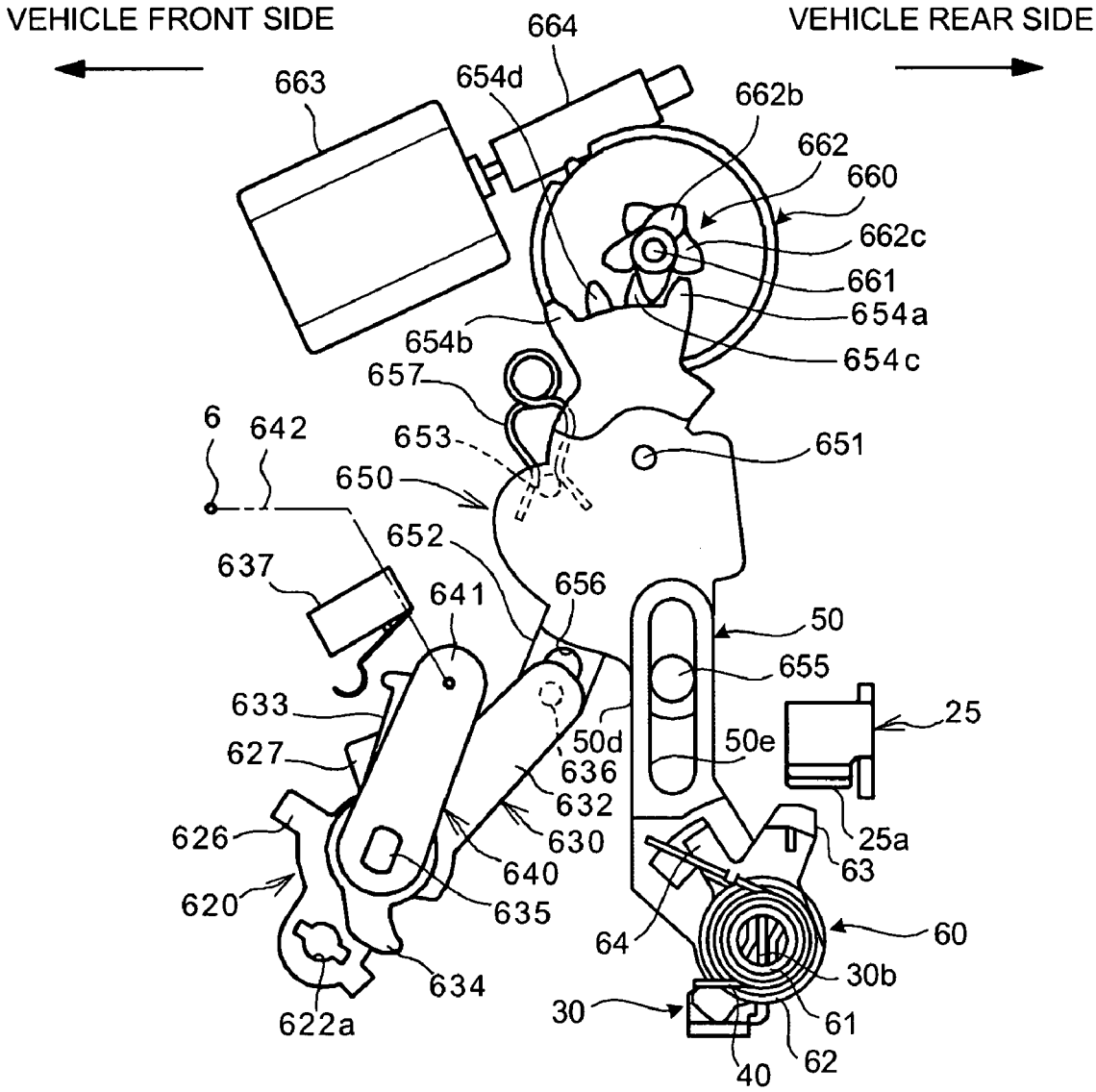
FIG. 18 is a conceptual diagram of the lock mechanism unlocked by actuation of a drive motor.
Figure 19:
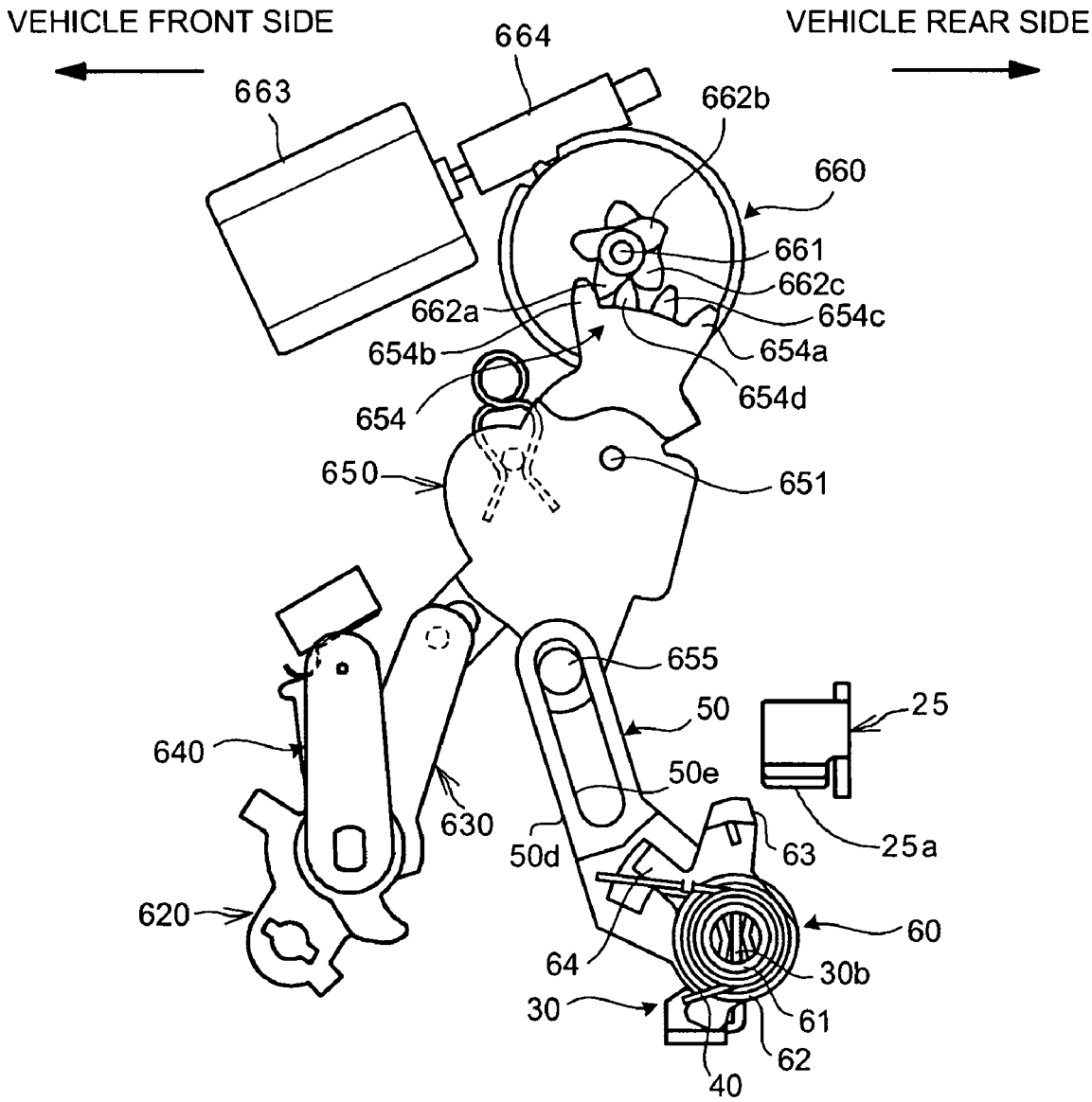
FIG. 19 is a conceptual diagram of the lock mechanism locked by actuation of the drive motor.

As shown in FIGS. 18 and 19, the worm wheel 660 is rotatably provided on a worm shaft 661 above the locking lever 650 and extending essentially horizontally in the widthwise direction of the vehicle body. An intermittent gear 662 is concentrically fixed to the worm wheel 660.

The intermittent gear 662 of the worm wheel 660 includes a base tooth 662*a*, a pair of first driving teeth 662*b*, and a pair of second driving teeth 662*c*. The intermittent gear 662 forms a unidirectional gearing between the intermittent gear 662 and the first and second driven tooth 654*c* and 654*d* and the pair of outer teeth 654*a* and 654*b* on the driven gear 654 of the locking lever 650. More specifically, as in the case of the outer teeth 654*a* and 654*b*, the first driven tooth 654*c*, and the second driven tooth 654*d* of the driven gear 654, the base tooth 662*a*, the first driving teeth 662*b*, and the second driving teeth 662*c* of the intermittent gear 662 are arranged along an extending direction of the worm shaft 661 at three levels which differ from each other in terms of height. In addition, these teeth are arranged such that the base tooth 662*a* meshes only with the outer tooth 654*a* or 654*b*, the first driving tooth 662*b* meshes only with the first driven tooth 654*c*, and the second driving tooth 662*c* meshes only with the second driven tooth 654*d*. Although not clearly shown, a return-to-neutral spring is disposed between the worm wheel 660 and the main casing 2. The return-to-neutral spring maintains the worm wheel 660 in a position (hereinafter, "neutral position") in which the base tooth 662*a* of the intermittent gear 662 of the worm wheel 660 is oriented toward the axis of the gear shaft 651.

When the locking lever 650 is rotated clockwise about the gear shaft 651 from the position (hereinafter, "unlocked position") shown in FIG. 18 to the position (hereinafter, "locked position") shown in FIG. 19, none of the teeth 654*a*, 654*b*, 654*c*, and 654*d* in the driven gear 654 of the locking lever 650 meshes with any one of teeth 662*a*, 662*b*, and 662*c* of the intermittent gear 662. Thus, the clockwise rotation of the locking lever 650 does not rotate the worm wheel 660.

Similarly, rotating the locking lever 650 counterclockwise about the gear shaft 651 from the locked position shown in FIG. 19 to the unlocked position shown in FIG. 19 does not rotate the worm wheel 660.

As shown in FIGS. 18 and 19, the worm wheel 660 is meshed with a worm 664 fixed to an output shaft of a drive motor 663. As shown in FIG. 4, the drive motor 663 is disposed at an uppermost position inside the housing 10. This arrangement prevents, even when grease applied to a mechanism inside the housing 10 is liquefied, the grease from reaching the drive motor 663. In other words, the arrangement can prevent intrusion of the grease into the drive motor 663.

When the drive motor 663 is actuated to rotate the worm wheel 660 from the position shown in FIG. 18 counterclockwise about the worm shaft 661, the base tooth 662*a* meshes with the outer tooth 654*a*, the first driving tooth 662*b* then meshes with the first driven tooth 654*c*, and thereafter the second driving tooth 662*c* meshes with the second driven tooth 654*d*. Hence, as shown in FIG. 19, the locking lever 650 is rotated clockwise about the gear shaft 651 via the driven gear 654. As the locking lever 650 is thus rotated clockwise, the first link lever 50 and the second link lever 60 are rotated counterclockwise about the opening-action arm 30*b* of the opening lever 30 to thus be moved to the locked position.

After the first link lever 50 and the second link lever 60 having been moved from the unlocked position shown in FIG. 18 to the locked position shown in FIG. 19 by the rotation of the worm wheel 660, the intermittent gear 662 is not allowed to rotate the first and the second link levers 50 and 60 any more. Accordingly, a resilient restoring force of the return-to-neutral spring causes the worm wheel 660 to return to the neutral position without causing the first and the second link levers 50 and 60 to rotate.

Similarly, when the worm wheel 660 is rotated from the position shown in FIG. 19 clockwise about the worm shaft 661, the base tooth 662*a* meshes with the outer tooth 654*b*, the second driving tooth 662*c* then meshes with the second driven tooth 654*d*, and thereafter the first driving tooth 662*b* meshes with the first driven tooth 654*c*. Hence, as shown in FIG. 18, the locking lever 650 is rotated counterclockwise about the gear shaft 651 via the driven gear 654. As the locking lever 650 is thus rotated counterclockwise, the first link lever 50 and the second link lever 60 are rotated clockwise about the opening-action arm 30*b* of the opening lever 30 to thus be moved to the unlocked position.

After the first and the second link levers 50 and 60 having been moved from the locked position shown in FIG. 19 to the unlocked position shown in FIG. 18 by the rotation of the worm wheel 660, the intermittent gear 662 is not allowed to rotate the first and the second link levers 50 and 60 any more. Accordingly, the resilient restoring force of the return-to-neutral spring causes the worm wheel 660 to return to the neutral position without rotating the first and the second link levers 50 and 60.

When the lock mechanism 600 is in the unlocked state, as shown in FIGS. 8 and 10, the ratchet driver 63 of the second link lever 60 is located below the abutting portion 25*a* in the ratchet lever 25.

When, in this unlocked state, the outside handle 1 is operated to open the door and the opening lever 30 is rotated counterclockwise in FIG. 8 about the opening lever shaft 31, as shown in FIG. 9, the first and the second link levers 50 and 60 are moved upward. This causes the ratchet driver 63 to press and move the abutting portion 25*a* of the ratchet lever 25 upward. As a result, abutting engagement between the hook portion 21*b* of the latch 21 and the engaging portion 22*a* of the ratchet 22 is released, which allows the door D to be opened with respect to the vehicle body.

When, in the unlocked state, the inside handle 5 is operated to open the door and the inner handle lever 70 is rotated counterclockwise in FIG. 10 about the inner lever shaft 71, as shown in FIG. 11, the single-motion link 76 is moved upward, thereby moving and pressing the abutting portion 25*a* of the ratchet lever 25 upward. As a result, abutting engagement between the hook portion 21*b* of the latch 21 and the engaging portion 22*a* of the ratchet 22 is released, which allows the door D to be opened with respect to the vehicle body.

When, with the door D in the closed position, the inside lock knob 6 in the unlocked position shown in FIG. 14 is operated in the direction to lock the door D, the external-force transmitting lever 640 is rotated as shown in FIG. 15, causing the connecting lever 630 to pivot counterclockwise about the projection 201. This in turn causes the locking lever 650 that is coupled to the connecting lever 630 via the coupling projection 636 and the coupling slot 656 to pivot clockwise about the gear shaft 651. The clockwise pivoting of the locking lever 650 rotates the first link lever 50 counterclockwise. Hence, the first link lever 50 presses the second link lever 60 and rotates counterclockwise integrally therewith, thereby bringing the lock mechanism 600 into the locked state.

Even when, in this locked state, an attempt to open the door using the outside handle 1 is made and thereby the opening lever 30 is rotated clockwise in FIG. 1, the ratchet driver 63 of the second link lever 60 and the abutting portion 25*a* of the ratchet lever 25 are away from each other as shown in FIG. 15. Hence, the ratchet driver 63 and the abutting portion 25*a* are not brought into contact with each other, and the hook portion 21*b* of the latch 21 is not disengaged from the engaging portion 22*a* of the ratchet 22. Thus, the door D is maintained in the closed position with respect to the vehicle body, which allows the vehicle to be locked.

Shifting from the unlocked state shown in FIG. 14 to the locked state shown in FIG. 15 is not necessary carried out by the locking operation performed using the inside lock knob 6. Alternatively, as shown in FIG. 19, the shifting can be carried out by actuating the drive motor 663 to rotate the worm wheel 660 counterclockwise about the worm shaft 661 to thereby rotate the locking lever 650 clockwise about the gear shaft 651. Further alternatively, the shifting can be carried out by turning the key cylinder KC using the key to thereby rotate the key sub lever 620 counterclockwise about the projection 302 as shown in FIG. 13.

When, in the locked state, the inside lock knob 6 is operated in the direction to unlock the door, the external-force transmitting lever 640 is rotated as shown in FIG. 14, causing the connecting lever 630 to pivot clockwise about the projection 201. This in turn causes the locking lever 650 that is coupled to the connecting lever 630 via the coupling projection 636 and the coupling slot 656 to pivot counterclockwise about the gear shaft 651. When the locking lever 650 is rotated counterclockwise, the first link lever is rotated clockwise, and the resilient force of the spring rotates the second link lever 60 clockwise following the first link lever 50. Thus, the lock mechanism 600 is unlocked.

Figure 16:
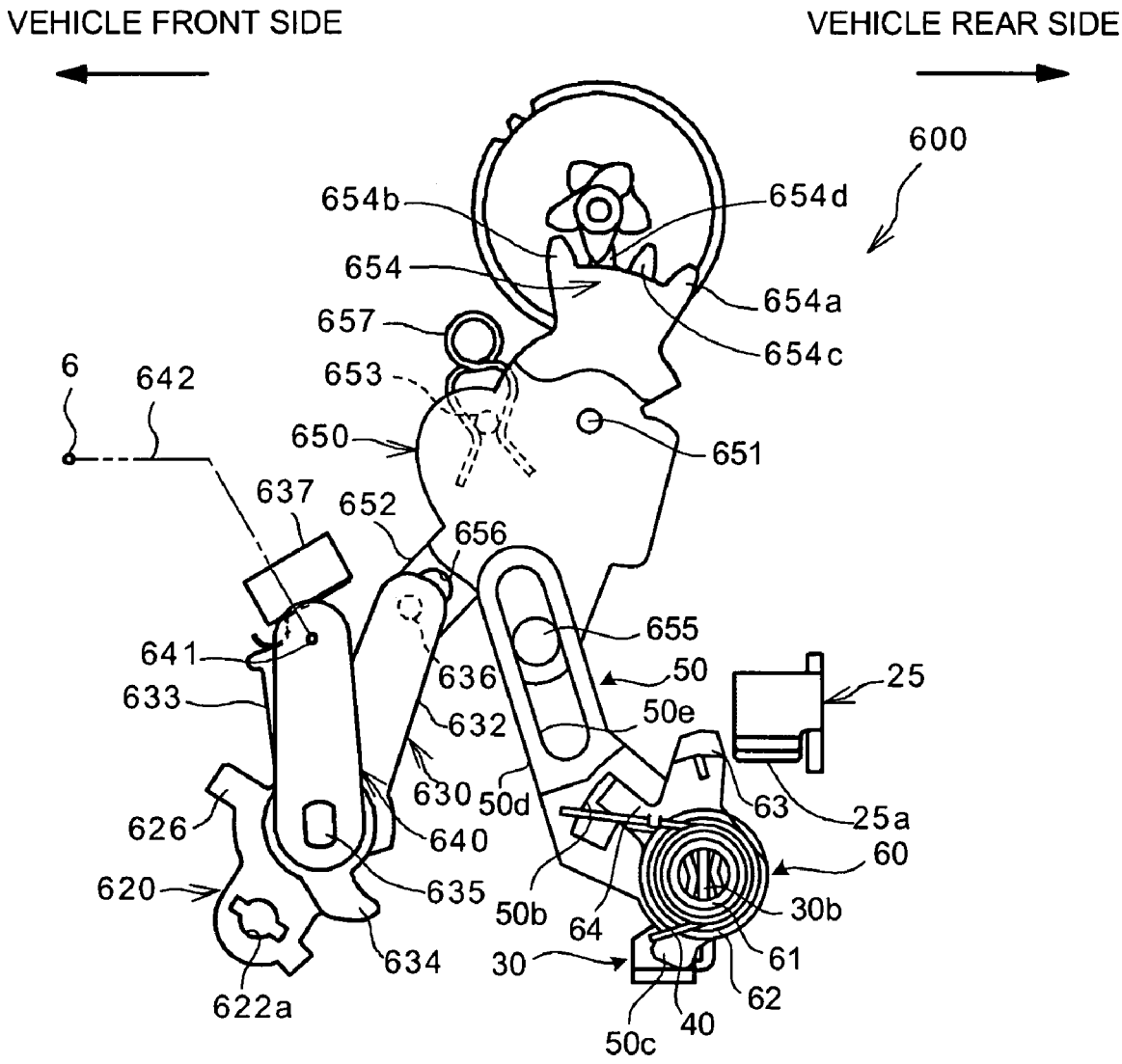
FIG. 16 is a conceptual diagram of the lock mechanism with the locking lever in the locked position and the opening lever moved to an operable position.
Figure 17:
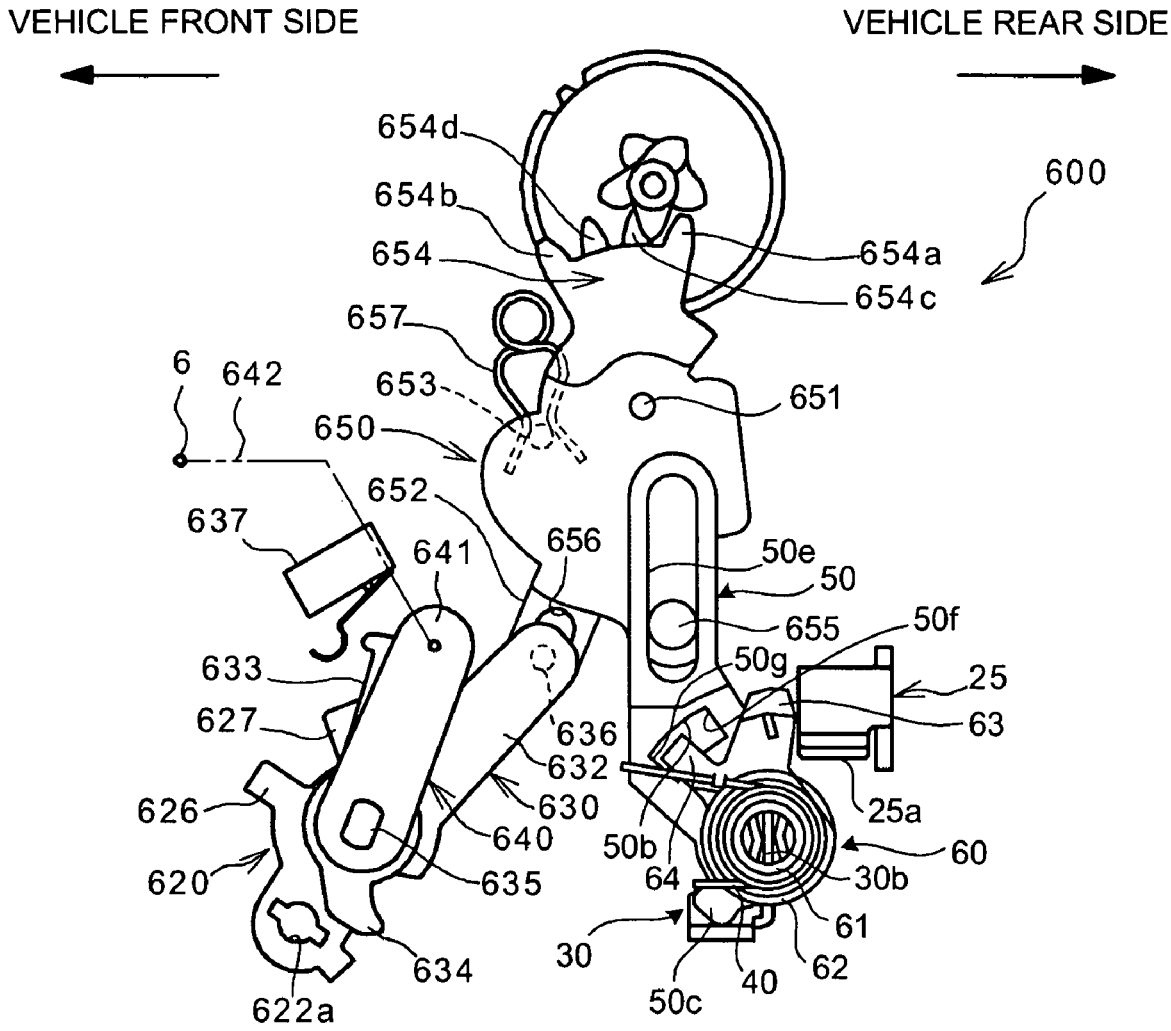
FIG. 17 is a conceptual diagram of the lock mechanism with the locking lever moved to the unlocked position from the locked position shown in FIG. 16.

Performing the door-opening operation in the locked state shown in FIG. 15 brings the door lock system to the state shown in FIG. 16. More specifically, the first and the second link levers 50 and 60 are moved upward by the door-opening operation; however, the ratchet driver 63 of the second link lever 60 moves to a position laterally spaced from the abutting portion 25*a* of the ratchet lever 25 rather than coming into contact with the abutting portion 25*a*. When the inside lock knob 6 is operated in the direction to unlock the door in the course of the door-opening operation shown in FIG. 16, the locking lever 650 is rotated counterclockwise about the gear shaft 651. By the counterclockwise rotation of the locking lever 650, the first and the second link levers 50 and 60 are urged to rotate clockwise to the transmitting position. However, because the ratchet driver 63 of the second link lever 60 comes into contact with the side of the abutting portion 25*a* of the ratchet lever 25, the second link lever 60 is retained at the non-transmitting position. On the other hand, in the opening 50*b* in the first link lever 50, the first-link-lever abutting portion 64 of the second link lever 60 is moved from the side wall 50*f* toward the side wall 50*g* relative to the first link lever 50. As a result, the first link lever 50, which is interlocked with the locking lever 650, is moved to the unlocked position. FIG. 17 depicts this state. Hereinafter, the position of the ratchet driver 63 when the projection 64*a* has been moved to the side wall 50*g* of the opening 50*b* is referred to as a "second rotational position".

When the outside handle 1 is released in the state shown in FIG. 17, the opening lever 30 is moved from the operable position to the non-operable position, causing the ratchet driver 63 of the second link lever 60 to move to a position below the abutting portion 25*a* of the ratchet lever 25. The resilient restoring force of the spring 40 rotates the second link lever 60 clockwise, thereby moving the ratchet driver 63 from the second rotational position to the first rotational position. Thus, the door lock system is unlocked as shown in FIG. 14. When the door-opening operation is performed in this state using the outside handle 1 again, the door can be successfully opened.

Shifting from the locked state shown in FIG. 15 to the unlocked state shown in FIG. 14 is not necessary carried out by the unlocking operation using the inside lock knob 6. As shown in FIG. 18, the shifting can be carried out by actuating the drive motor 663 to rotate the worm wheel 660 clockwise about the worm shaft 661, so that the locking lever 650 rotates clockwise about the gear shaft 651. The shifting can also be carried out by turning the key cylinder KC using the key to thereby rotate the key sub lever 620 clockwise about the projection 201 as shown in FIG. 12.

In the door lock system, when the inside handle 5 is operated to open the door, the single-motion lever 73 that rotates integrally with the inner handle lever 70 causes the connecting lever 630 to rotate, and the connecting lever 630 in turn rotates the locking lever 650. As a result, the first and the second link levers 50 and 60 are moved from the locked position to the unlocked position while the single-motion link 76 attached to the inner handle lever 70 simultaneously transmits the door-opening operation performed using the inside handle 5 to the ratchet, lever 25. Thus, a single-motion mechanism is provided. Meanwhile, the door-opening operation performed using the inside handle 5 is transmitted to the ratchet lever 25 via the single-motion link 76 without by way of the first and the second link levers 50 and 60. This allows to set a timing at which the first and the second link levers 50 and 60 are to be moved from the locked position to the unlocked position and a timing at which the single-motion link 76 transmits the door-opening operation performed using the inside handle 5 to the ratchet lever 25 as required. Thus, even for a door lock system with the single-motion mechanism, an unlocking timing and a door-opening timing can be set with consideration given to the operation feeling.

In the door lock system, the bushing 61 inserted into one end of the opening lever 30 and supported thereon rotatably about its axis, and the ratchet driver 63 that transmits the door-opening operation to the ratchet lever 25 are formed integrally as a unit. This allows to reduce the number of components as compared with a door lock system having a conventional anti-panic mechanism, and hence to attain cost reduction.

As set forth hereinabove, according to an embodiment of the present invention, a door lock system requires a less number of components as compared with the one having a conventional anti-panic mechanism, which enables cost reduction. Moreover, assembly work is facilitated as compared with a structure that requires assembling a link lever and a spring independently into a housing.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

This application claims priority from Japanese Patent Application 2006-271107, filed Oct. 2, 2006, which is incorporated herein by reference in its entirety.

What is claimed is:

1. A door lock system comprising:

a latch;

a ratchet that engages with the latch;

a ratchet lever that is interlocked with the ratchet and is configured to disengage the ratchet from the latch;

an opening lever that moves from a non-operable position to an operable position in response to a door-opening operation;

a first link lever that moves to a first position, in response to an unlocking operation, to allow the ratchet lever to disengage the ratchet from the latch, and moves to a second position, in response to a locking operation, to prevent the ratchet lever from disengaging the ratchet from the latch;

a second link lever including a cylindrical bushing and a ratchet driver, wherein the cylindrical bushing is connected to an end of the opening lever; and a spring that is interposed between the first link lever and the second link lever, wherein the spring maintains the second link lever in a first rotational position with respect to the first link lever by a resilient force of the spring when the first link lever moves from the second position to the first position, wherein the ratchet driver is formed integrally with the cylindrical bushing, extends radially outward from the cylindrical bushing, and is rotatable between the first rotational position and a second rotational position with respect to the first link lever, wherein the ratchet driver is configured to allow, when in the first rotational position, the ratchet lever to disengage the ratchet from the latch in response to the door-opening operation performed on the opening lever when the first link lever is in the first position.

2. The door lock system according to claim 1, wherein the second link lever further includes a spring receptacle for housing the spring therein.

* * * * *